US007559428B2

(12) United States Patent
Matzick

(10) Patent No.: US 7,559,428 B2
(45) Date of Patent: Jul. 14, 2009

(54) GUN RACK

(76) Inventor: Rick Edwin Matzick, P.O. Box 189, Ennis, MT (US) 59729

( * ) Notice: Subject to any disclaimer, the term of this patent is extended or adjusted under 35 U.S.C. 154(b) by 221 days.

(21) Appl. No.: 11/166,017

(22) Filed: Jun. 24, 2005

(65) Prior Publication Data

US 2007/0000851 A1 Jan. 4, 2007

(51) Int. Cl.
*A47F 7/00* (2006.01)

(52) U.S. Cl. ..... 211/64; 211/70

(58) Field of Classification Search ..... 211/64, 211/196, 205, 60.1, 68, 70, 163, 78, 4, 165, 211/168; 248/292.11, 292.14, 294.1, 316.8, 248/185.1

See application file for complete search history.

(56) References Cited

U.S. PATENT DOCUMENTS

| | | | | | |
|---|---|---|---|---|---|
| 405,335 | A | | 6/1889 | Amerine | |
| 492,304 | A | | 2/1893 | Markle | |
| 505,320 | A | | 9/1893 | Meadows | |
| 712,428 | A | | 10/1902 | Whitcomb | |
| 722,514 | A | * | 3/1903 | Johnson | 211/70 |
| 970,046 | A | * | 9/1910 | Hampton | 211/70 |
| 1,096,722 | A | * | 5/1914 | Johnson | 211/60.1 |
| 1,144,229 | A | * | 6/1915 | Mueller | 211/70 |
| 1,257,107 | A | * | 2/1918 | Patterson | 211/64 |
| 1,478,043 | A | * | 12/1923 | Matteson | 211/68 |
| 1,757,600 | A | * | 5/1930 | Sprowle | 211/64 |
| 2,158,623 | A | * | 5/1939 | Fischbacher | 312/6 |
| 2,512,622 | A | | 6/1950 | Fish | |
| 2,869,729 | A | | 1/1959 | Hayden | |
| 3,182,946 | A | * | 5/1965 | Dudko | 248/292.14 |
| 3,685,661 | A | | 8/1972 | Kimmel | |
| 3,762,789 | A | | 10/1973 | Robertson | |
| 3,826,378 | A | * | 7/1974 | Novak | 211/70.5 |
| 3,927,923 | A | | 12/1975 | Kimmel | |
| 3,981,405 | A | * | 9/1976 | Slack | 211/70 |
| 4,099,808 | A | * | 7/1978 | Oakley et al. | 312/297 |
| 4,222,490 | A | * | 9/1980 | Wood, Jr. | 211/70.5 |
| 4,671,476 | A | * | 6/1987 | Yim | 248/117.2 |
| 4,688,685 | A | * | 8/1987 | Brace | 211/70.5 |
| 4,696,405 | A | * | 9/1987 | Waring | 211/4 |
| 4,834,332 | A | * | 5/1989 | Vanderbilt | 248/292.14 |
| 5,285,906 | A | * | 2/1994 | Wisnowski et al. | 211/70.5 |
| D348,576 | S | | 7/1994 | Narramore | |
| D379,881 | S | | 6/1997 | Gregg, III et al. | |
| 5,676,261 | A | | 10/1997 | Baughman et al. | |
| D408,174 | S | | 4/1999 | Aspenwall | |
| 5,979,846 | A | * | 11/1999 | Fluhr | 248/200 |
| 6,305,534 | B1 | * | 10/2001 | Neal | 206/315.11 |

(Continued)

*Primary Examiner*—Jennifer E. Novosad
(74) *Attorney, Agent, or Firm*—Antoinette M. Tease

(57) ABSTRACT

A gun rack comprising a plurality of swivel shoes and a plate or disc, wherein each swivel shoe is pivotally attached on either side to a bracket on the plate or disc, and wherein the swivel shoe is shaped to hold the butt of a gun. A gun rack comprising a top receiver disc, a bottom receiver disc, a base unit, a shaft, a plurality of swivel shoes, a plurality of barrel receivers, and a plurality of barrel receiver brackets, wherein each swivel shoe is pivotally attached on either side to a barrel receiver bracket, and wherein the barrel receiver brackets are attached to the bottom receiver disc. The barrel receivers insert into notches on the barrel receiver brackets and are optionally vertically adjustable. An optional shotgun plate for use in lieu of a barrel receiver. An optional pistol pole for holding pistols.

10 Claims, 25 Drawing Sheets

U.S. PATENT DOCUMENTS

| | | | | |
|---|---|---|---|---|
| 6,868,975 | B2 | 3/2005 | Sells et al. | |
| 7,077,370 | B2 * | 7/2006 | Lin et al. | 248/176.2 |
| 2003/0015486 | A1 * | 1/2003 | Chen | 211/70 |
| 2004/0045914 | A1 | 3/2004 | Sells et al. | |
| 2004/0164036 | A1 | 8/2004 | Cummins | |

* cited by examiner

GUN RACK

BACKGROUND OF THE INVENTION

1. Field of the Invention

The present invention relates to the field of storage devices, and more specifically, to a gun rack.

2. Description of the Related Art

There are a number of gun racks that are the subject of issued patents or pending patent applications, but none of these gun racks includes the novel features of the present invention, most notably, the alternating vertical placement of the guns butt to barrel, the swivel shoes for holding the gun butts, and vertically adjustable barrel receivers. Several examples of the prior art are discussed below.

U.S. Pat. No. 405,335 (Amerine, 1889) discloses a gun rack and glass case, in which the guns are positioned around the outside of the glass case. The gun butts are held in place by a series of notches in the lower support member.

U.S. Pat. No. 492,304 (Markle, 1893) provides a gun case in which the butts of the guns are held by grooves in the lower disks of the rack. Two lower disks are included to accommodate guns of different lengths.

U.S. Pat. No. 505,320 (Meadows, 1893) describes a rack for firearms in which the butts of the guns are held in place by recesses in the bottom platform. This rack can also be adapted to hold pistols by piercing the upper platform with holes for receiving the barrels of the pistols.

U.S. Pat. No. 712,428 (Whitcomb, 1902) covers a gun rack in which the gun butts are suspended in the air underneath the lower disc. Each gun is held in place by an opening in the lower disc designed to hold the breech-block, an opening in the lower disc designed to hold the stock and lock, and a keyhole-slot in the upper disc designed to hold the muzzle.

U.S. Pat. No. 1,257,107 (Patterson, 1918) discloses a gun rack in which the gun butts are held in place by openings in the bottom receiver disc. The guns are prevented from falling to the floor by a series of brackets or "stirrups" that lie underneath the openings in the bottom receiver disc.

U.S. Pat. No. 1,757,600 (Sprowle, 1929) provides a gun rack with three horizontal discs. The butts of the guns rest on the floor, and the guns are leaned back into recesses or notches on the upper and lower disks. The middle disc serves as a mechanism for locking the guns in position on the rack.

U.S. Pat. No. 2,512,622 (Fish, 1950) describes a waterproof container for storing firearms over a protracted period of time. Inside the container is a horizontal, circular gun rack requiring the alternate placement of guns butt to barrel. Each gun butt rests on top of a knob that protrudes from the inside of one of the two drums on either side of the container, and the gun barrels fit into sockets on the two drums.

U.S. Pat. Nos. 2,869,729 (Hayden, 1954) and 2,869,729 (Hayden, 1959) cover a gun rack that is secured to the ground by a ground-engaging shaft and a plurality of ground-engaging tines that extend from the bottom of the base plate or disc. On top of the disc are radial arms that extend outward from the center of the rack and that are connected to gun butt receivers on their outward ends. The gun butt receivers are fixed, non-pivoting platforms that extend upward from the radial arms.

U.S. Pat. No. 3,685,661 (Kimmel, 1972) discloses a revolving gun cabinet that comprises an upper and a lower disc, with no accommodation for the gun butts on the lower disc other than a lip around the perimeter of the lower disc.

U.S. Pat. No. 3,762,789 (Robertson, 1973) provides a gun cabinet comprising a protective shell that is anchored to the floor. Inside the shell is a rack with a bottom plate, on which are formed U-shaped compartments for containment of the gun butts. This rack does not appear to include any particular accommodation for the gun barrels.

U.S. Pat. No. 3,927,923 (Kimmel, 1975) describes a cabinet-enclosed, power-rotated gun rack. In this rack, the gun butts fit into recesses in the bottom rotor. The recesses generally conform in their outline shape to that of the average gun butt. Inside each recess is a convexly curved butt-supporting piece. The outwardly convex shape of this piece is generally complementary to the concave shape of the shoulder-engaging end of the average gun butt.

U.S. Pat. No. 4,099,808 (Oakley et al., 1978) covers not only a gun rack but also a steel security cabinet in which the rack is placed. The gun butts are supported by recesses in a circular gun butt support located at the bottom of the rack.

U.S. Pat. No. 6,868,975 (Sells et al., 2005) and U.S. Patent Application Pub. No. 2004/0045914 (Sells et al.) disclose a revolving gun safety cabinet in which the lower horizontal disc of the gun rack is adapted to hold the gun butts, and the upper horizontal disc holds the gun barrels. A vertical post joins the upper and lower horizontal discs, and a plurality of bolts extend outward from the vertical post at a location in between the upper and lower horizontal discs. The guns are locked in place by a locking means at the distal end of each bolt.

U.S. Patent Application Pub. No. 2004/0164036 (Cummins) provides a gun storage carousel in which the gun butts are held by slots in the base, and a top cabinet is secured to the upper end of the main post.

There are also a number of design patents that cover specific designs for gun racks. By way of example, U.S. Pat. No. D348,576 (Narramore, 1994) shows a gun cabinet design in which a rotating gun rack is enclosed in a cabinet with glass doors. The rotating gun rack has recesses on the bottom plate for receiving the gun butts. There is no provision for inverted (barrel-down) guns.

U.S. Pat. No. D379,881 (Gregg, III et al., 1997) shows a locking gun rack with three horizontal discs and a top attachment shaped like a lampshade that appears to be designed to hold pistols. This rack is designed for barrel-up guns only.

U.S. Pat. No. D408,174 (Aspenwall, 1999) shows a rifle display cabinet containing a gun rack. The bottom disc of the gun rack has angled recesses for holding the gun butts. This rack does not accommodate inverted (barrel-down) guns.

The following patents relate to racks for elongate objects, but they are not specifically designed for holding guns. U.S. Pat. No. 4,688,685 (Brace, 1987) describes a rack assembly for elongated objects such as skis and ski poles. The assembly comprises a base portion, a vertical post, and two horizontal sprocket members. The rack does not rotate, and there are no accommodations for gun stocks.

U.S. Pat. No. 5,676,261 (Baughman et al., 1997) covers a rotating fishing rod and pool cue holder. The holder comprises a foundation plate, a turntable assembly, and a base plate. The base plate has a number of recesses for supporting the bottoms of the stored items. The holder further comprises a top plate, which has the same number of recesses as the base plate. The top ends of rods or cues are locked into place by a recess closure lock on the top plate.

BRIEF SUMMARY OF THE INVENTION

The present invention generally covers a gun rack comprising a plate or disc and a plurality of swivel shoes, wherein each swivel shoe is pivotally attached on either side to a bracket on the plate or disc, and wherein the swivel shoe is shaped to hold the butt of a gun.

In one embodiment, the gun rack of the present invention comprises a top receiver disc, a bottom receiver disc, a base unit, a shaft, a plurality of swivel shoes, a plurality of barrel receivers, and a plurality of barrel receiver brackets, wherein the shaft is attached to the top receiver disc at one end and the bottom receiver disc at the other end, wherein the bottom receiver disc is attached to a bearing that allows the bottom receiver disc, shaft and top receiver disc to rotate, wherein the bearing is also attached to the base unit, wherein the number of barrel receivers equals the number of swivel shoes, wherein the number of barrel receiver brackets is twice the number of swivel shoes, wherein each swivel shoe is pivotally attached on either side to a barrel receiver bracket, and wherein the barrel receiver brackets are attached to the bottom receiver disc. Each barrel receiver comprises a rod and a ring, each barrel receiver bracket comprises at least two notches, there is a barrel receiver bracket on either side of each barrel receiver, the rod of each barrel receiver inserts into a notch on the barrel receiver bracket on either side of the barrel receiver, and the height of the barrel receiver can be adjusted by moving the barrel receiver up or down a notch. Furthermore, the notches on each barrel receiver bracket are lined up vertically.

In this embodiment, the top receiver disc comprises a plurality of cutouts for gun barrels and gun stocks, the cutouts for the gun stocks line up vertically with the barrel receivers, and the cutouts for the gun barrels line up vertically with the swivel shoes. The cutouts for the gun barrels can accommodate a rifle, single-barrel shotgun, or double-barrel shotgun (including side-by-side and over-and-under shotguns). This embodiment optionally includes a plurality of protective inserts, wherein the number of protective inserts equals the number of barrel receivers, and wherein the protective inserts are inserted into the barrel receivers.

In this embodiment, each swivel shoe comprises a rod that extends perpendicularly from either side of the swivel shoe, the rod comprises a circular portion and a semicircular portion, there is a barrel receiver bracket on either side of the swivel shoe, the barrel receiver brackets comprise cutouts for the swivel shoe rods, the semicircular portion of each rod is inserted into the cutout on the barrel receiver bracket, the circular portion of each rod prevents the swivel shoe from moving side to side, and the cutouts in the barrel receiver brackets are shaped so that the swivel shoe can pivot. Each swivel shoe comprises a toe and a heel, and the rod is preferably located closer to the heel of the swivel shoe than the toe.

This embodiment optionally includes at least one shotgun plate, wherein the shotgun plate is situated between two barrel receiver brackets, wherein the shotgun plate comprises at least two pegs, and wherein the pegs serve to hold the barrels of a side-by-side or over-and-under double-barrel shotgun. The top surface of the shotgun plate is optionally coated with a non-abrasive material, the outer surface of the pegs is also optionally coated with a non-abrasive material, and the non-abrasive material on the top surface of the shotgun plate and the outer surface of the pegs may or may not be the same material.

This embodiment also includes an optional pistol pole, wherein the pistol pole comprises a main branch, a side branch, an inwardly curved end, an insertion end, and a plurality of hooks, wherein the top receiver disc comprises a plurality of cutouts for gun stocks, wherein the inwardly curved end of the pistol pole is inserted into one of the gun stock cutouts in the top receiver disc, wherein the insertion end comprises a rod, wherein the insertion end of the pistol pole is situated between two barrel receiver brackets, wherein each barrel receiver bracket comprises at least one notch, and wherein each end of the rod is inserted into a notch in one of the two barrel receiver brackets on either side of the insertion end of the pistol pole.

In another embodiment, the gun rack of the present invention comprises a top receiver disc, a middle receiver disc, a bottom receiver disc, a base unit, a shaft, a plurality of swivel shoes, a plurality of barrel receivers, and a plurality of swivel shoe brackets, wherein the shaft is attached to the top receiver disc at one end and the bottom receiver disc at the other end, wherein the middle receiver disc is attached to the shaft at a point between the top and bottom receiver discs, wherein the bottom receiver disc is attached to a bearing that allows the bottom receiver disc, middle receiver disc, shaft and top receiver disc to rotate, wherein the bearing is also attached to the base unit, wherein the number of barrel receivers equals the number of swivel shoes, wherein the barrel receivers are attached to the bottom receiver disc in between the swivel shoes, wherein the number of swivel shoe brackets is twice the number of swivel shoes, wherein each swivel shoe is pivotally attached on either side to a swivel shoe bracket, and wherein the swivel shoe brackets are attached to the bottom receiver disc.

In this embodiment, the top receiver disc and the middle receiver disc each comprises a plurality of cutouts for gun barrels and gun stocks, wherein the cutouts for the gun stocks line up vertically with the barrel receivers, and wherein the cutouts for the gun barrels line up vertically with the swivel shoes. The cutouts for the gun barrels can accommodate a rifle, single-barrel shotgun, or double-barrel shotgun (side-by-side and over-and-under). This embodiment optionally includes a plurality of protective inserts, wherein the number of protective inserts equals the number of barrel receivers, and wherein the protective inserts are inserted into the barrel receivers.

In this embodiment, each swivel shoe comprises a rod that extends perpendicularly from either side of the swivel shoe, the rod comprises a circular portion and a semicircular portion, there is a swivel shoe bracket on either side of the swivel shoe, the swivel shoe brackets comprise cutouts for the swivel shoe rods, the semicircular portion of each rod is inserted into the cutout on the swivel shoe bracket, the circular portion of each rod prevents the swivel shoe from moving side to side, and the cutouts in the swivel shoe brackets are shaped so that the swivel shoe can pivot. Each swivel shoe comprises a toe and a heel, and the rod is preferably located closer to the heel of the swivel shoe than the toe.

In another embodiment, the gun rack of the present invention comprises a top receiver disc, a bottom receiver disc, a base unit, a shaft, and a plurality of swivel shoes, wherein the shaft is attached to the top receiver disc at one end and the bottom receiver disc at the other end, wherein the bottom receiver disc is attached to a bearing that allows the bottom receiver disc, shaft and top receiver disc to rotate, wherein the bearing is also attached to the base unit, wherein the number of swivel shoe brackets is twice the number of swivel shoes, wherein each swivel shoe is pivotally attached on either side to a swivel shoe bracket, and wherein the swivel shoe brackets are attached to the bottom receiver disc.

In this embodiment, the top receiver disc comprises a plurality of cutouts for gun barrels, and the cutouts for the gun barrels line up vertically with the swivel shoes. The cutouts for the gun barrels can accommodate a rifle, single-barrel shotgun, or double-barrel shotgun (side-by-side or over-and-under).

In this embodiment, each swivel shoe comprises a rod that extends perpendicularly from either side of the swivel shoe, the rod comprises a circular portion and a semicircular portion, there is a swivel shoe bracket on either side of the swivel shoe, the swivel shoe brackets comprise cutouts for the swivel shoe rods, the semicircular portion of each rod is inserted into the cutout on the swivel shoe bracket, the circular portion of each rod prevents the swivel shoe from moving side to side, and the cutouts in the swivel shoe brackets are shaped so that the swivel shoe can pivot. Each swivel shoe comprises a toe and a heel, and the rod is preferably located closer to the heel of the swivel shoe than the toe.

REFERENCE NUMBERS

Figure 1:
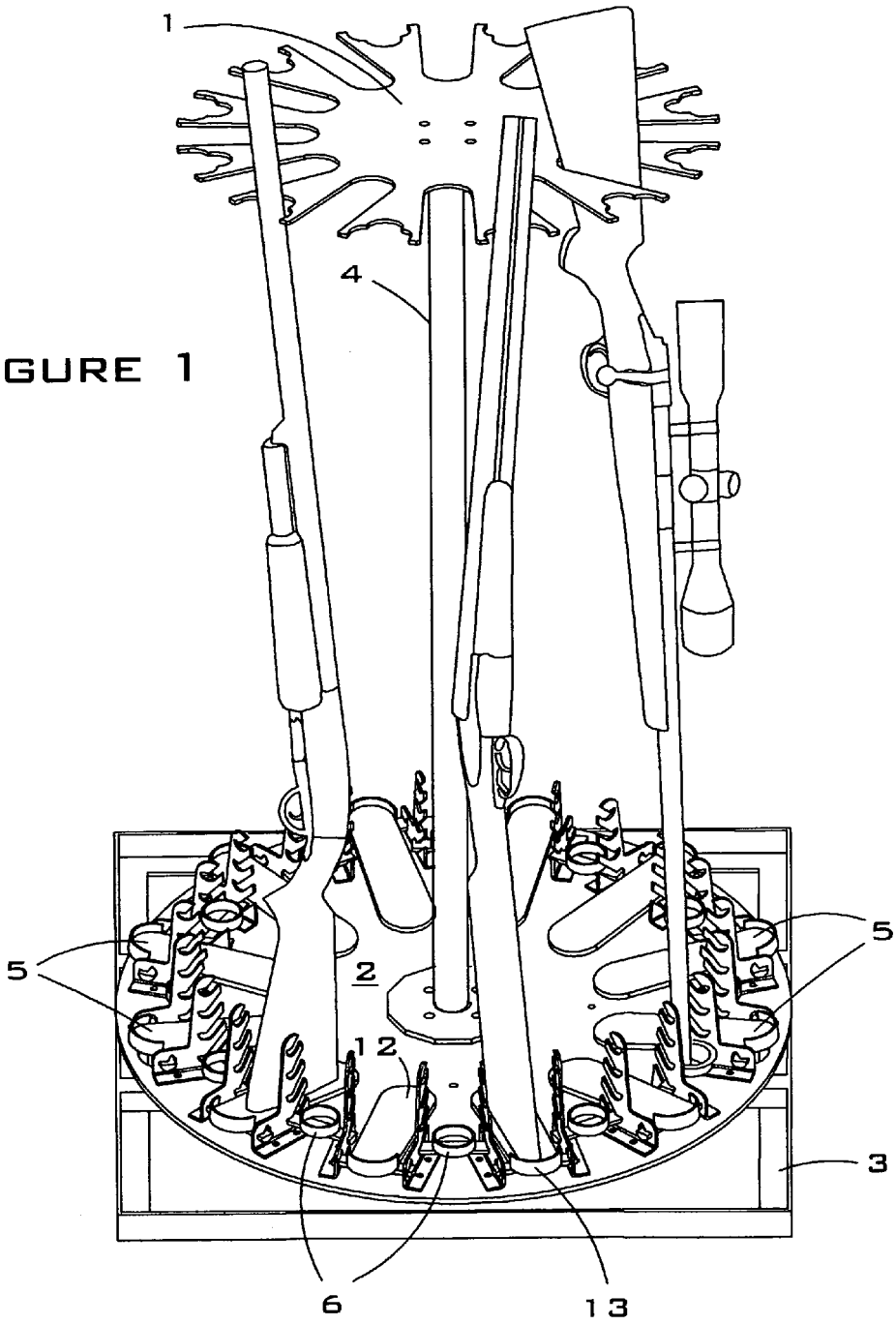
FIG. 1 is a perspective view of the first embodiment of the gun rack of the present invention.

1 Top receiver disc
2 Bottom receiver disc
3 Base unit
4 Shaft
5 Swivel shoe
6 Barrel receiver
7 Barrel receiver bracket
8 Protective insert
9 Cutout in top receiver disc for gun stocks
10 Cutout in top receiver disc for gun barrel
11 Rod
12 Toe of swivel shoe
13 Heel of swivel shoe
14 Bearing
15 Circular portion of rod
16 Semicircular portion of rod
17 Cutout in barrel receiver bracket or swivel shoe bracket (for swivel shoe)
18 Notch in barrel receiver bracket (for barrel receiver)
19 Ring
20 Shotgun plate
21 Pegs
22 Flange
23 Lateral wings
24 Middle receiver disc
25 Swivel shoe bracket
26 Main branch
27 Side branch
28 Inwardly curved end (of main branch)
29 Insertion end
30 Hooks

DETAILED DESCRIPTION OF INVENTION

The present invention includes three different embodiments of a gun rack and a pistol pole that can be used with the first embodiment. All three embodiments are free-standing, rotating gun racks, and all three embodiments incorporate the swivel shoe. The first embodiment is depicted in FIGS. 1-11.

FIG. 1 is a perspective view of the first embodiment of the gun rack of the present invention. This figure shows the top receiver disc 1, the bottom receiver disc 2, the base unit 3 and the shaft 4. It also shows the swivel shoes 5, which hold the gun butts, and the barrel receivers 6, which hold the gun barrels. As shown in greater detail in FIGS. 7 and 9, the barrel receiver brackets 7 support both the swivel shoes 5 and the barrel receivers 6 and allow both the swivel shoes 5 and the barrel receivers 6 to pivot. In this embodiment, the guns are placed on the rack in alternating positions, butt to barrel. This placement is possible due to the alternating swivel shoes and barrel receivers on the bottom receiver disc 2, as well as the cutouts on the top receiver disc for both gun stocks and barrels (discussed more fully in connection with FIG. 3).

In FIG. 1, the one barrel receiver 6 that is shown holding a gun barrel is also shown with a protective insert 8, which fits inside the barrel receiver 6 and serves to protect the gun barrel from wear. The protective insert can be made of any suitable material and is shown in greater detail in FIG. 9.

Figure 2:
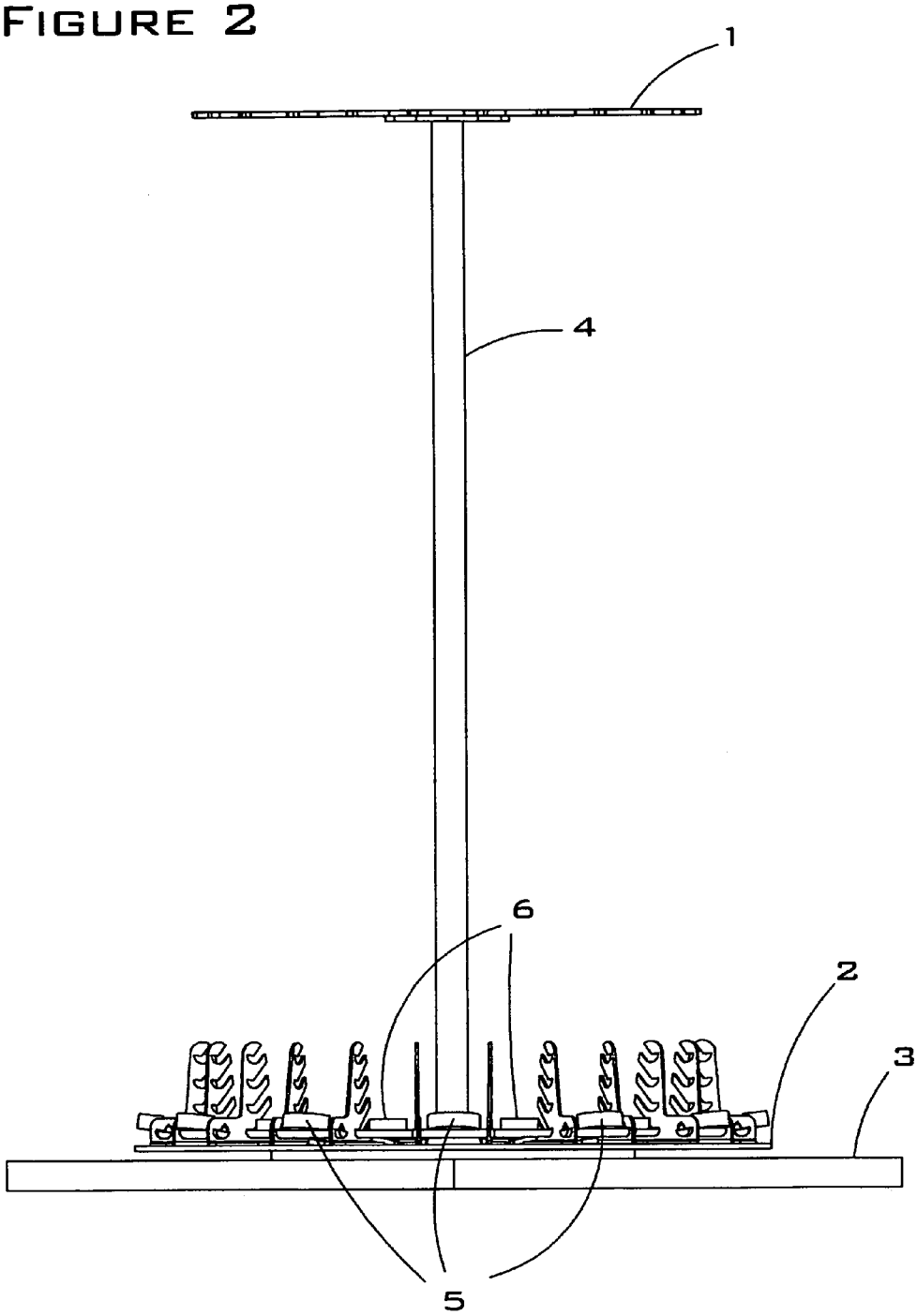
FIG. 2 is a side view of the first embodiment of the gun rack of the present invention.

FIG. 2 is a side view of the first embodiment of the gun rack of the present invention. This figure shows the top receiver disc 1, the bottom receiver disc 2, the base unit 3 and the shaft 4, as well as the swivel shoes 5 and barrel receivers 6. The present invention is not limited to any particular height, although the distance between the top and bottom receiver discs 1, 2 is preferably shorter than the length of an average shotgun or rifle. The shaft 4 is fixedly attached to both the top and bottom receiver discs 1, 2.

Figure 3:
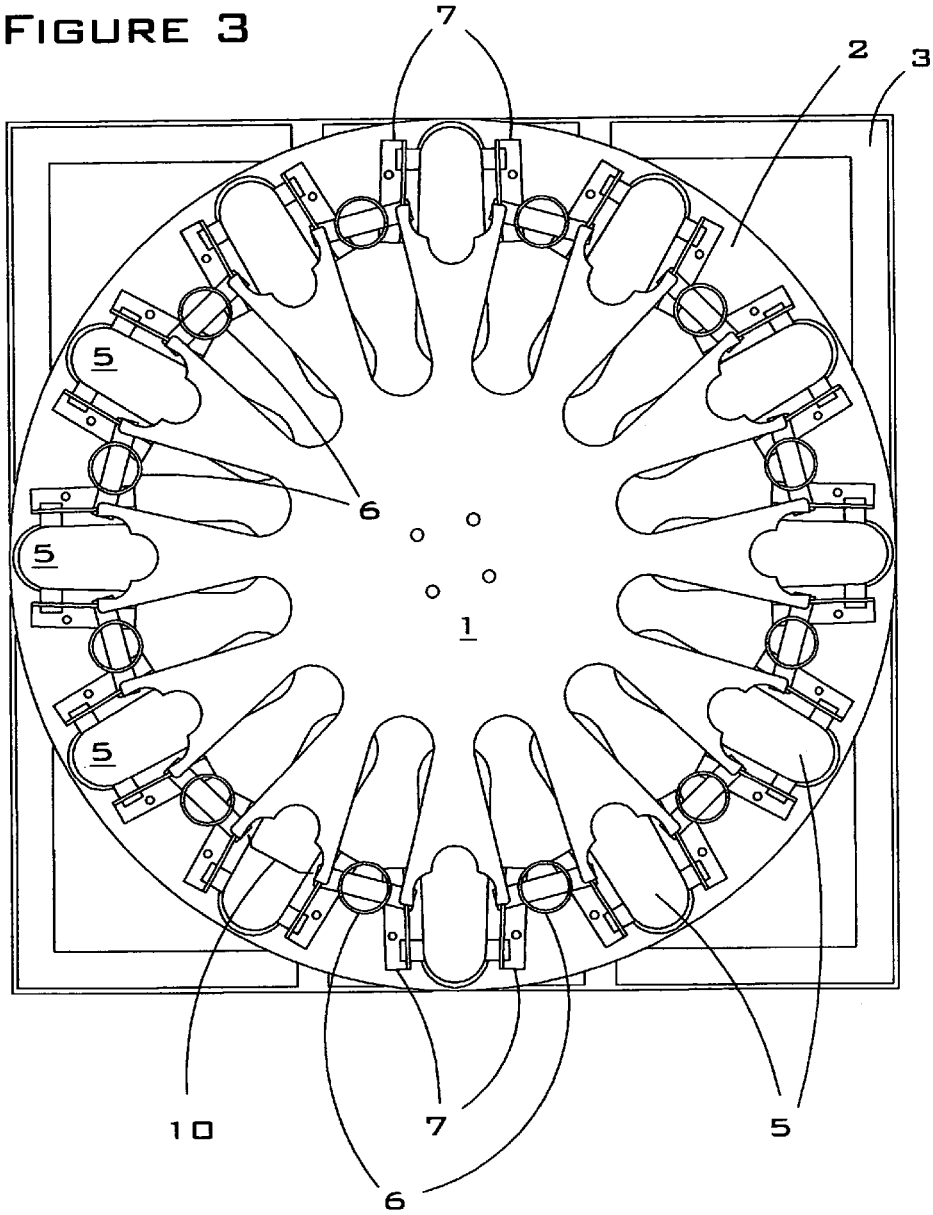
FIG. 3 is a top view of the first embodiment of the gun rack of the present invention.

FIG. 3 is a top view of the first embodiment of the gun rack of the present invention. This figure shows the top receiver disc 1, the bottom receiver disc 2, the base unit 3, the swivel shoes 5, the barrel receivers 6, and the barrel receiver brackets 7. The barrel receivers 6 are shown in this figure without the protective inserts 8, which are preferably removable. As illustrated in this figure, the top receiver disc 1 comprises cutouts 9 for the gun stocks, as well as cutouts 10 for the gun barrels. The cutouts 9, 10 are shown more clearly in FIG. 4. Note that the cutouts 9 for the gun stocks are positioned so that they line up vertically with the barrel receivers 6, and the cutouts 10 for the gun barrels are positioned so that they line up vertically with the swivel shoes 5. This aspect of the present invention allows the guns to be placed on the gun rack in alternating positions, butt to barrel.

Figure 4:
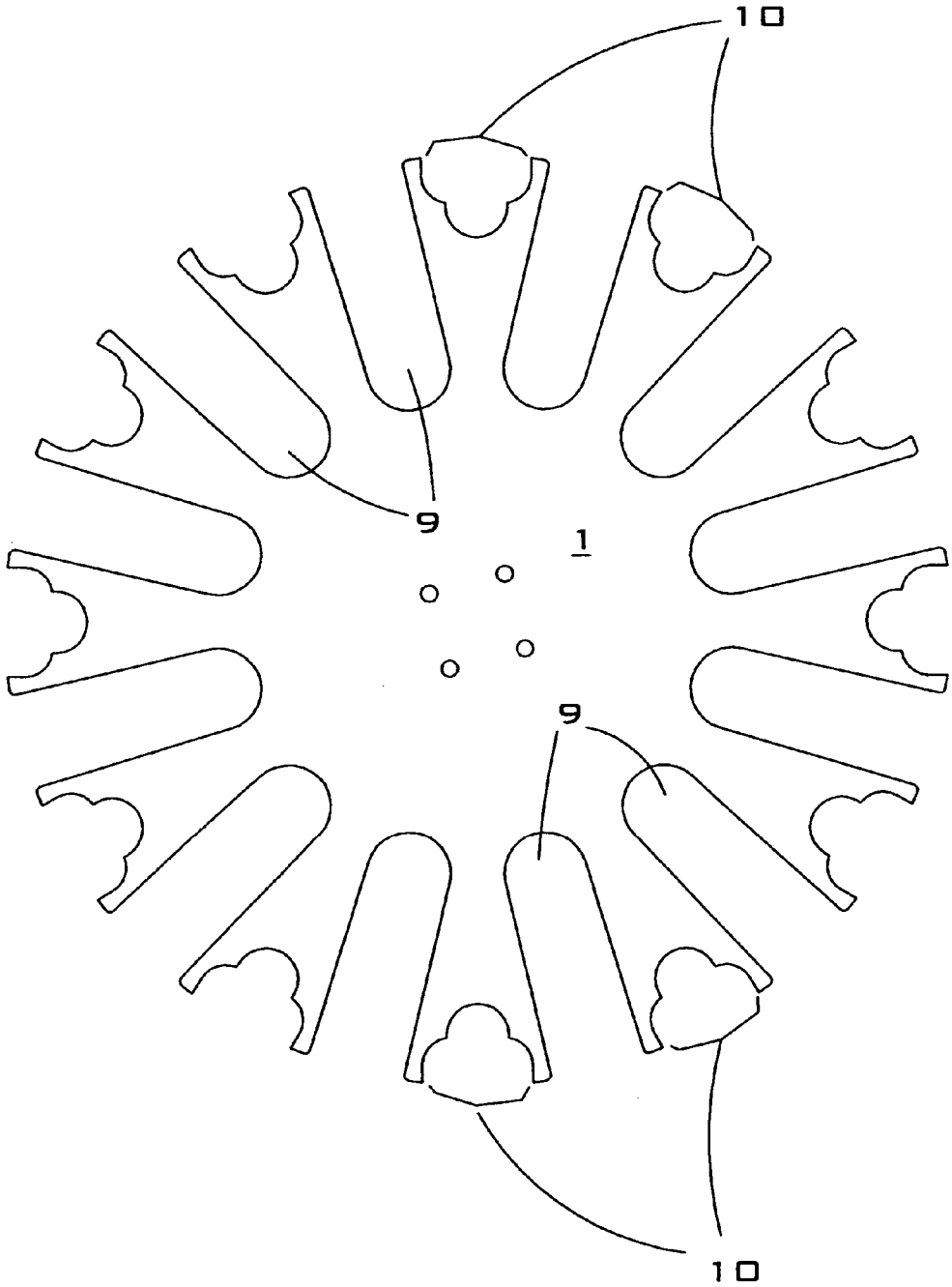
FIG. 4 is a top view of the top receiver disc of the first embodiment of the gun rack of the present invention.

FIG. 4 is a top view of the top receiver disc of the first embodiment of the gun rack of the present invention. This figure shows more clearly the cutouts 9 for the gun stocks and the cutouts 10 for the gun barrels. The cutouts 10 for the gun barrels are shaped so that they can accommodate a rifle, single-barrel shotgun, or double-barrel shotgun (side-by-side or over-and-under).

Figure 5:
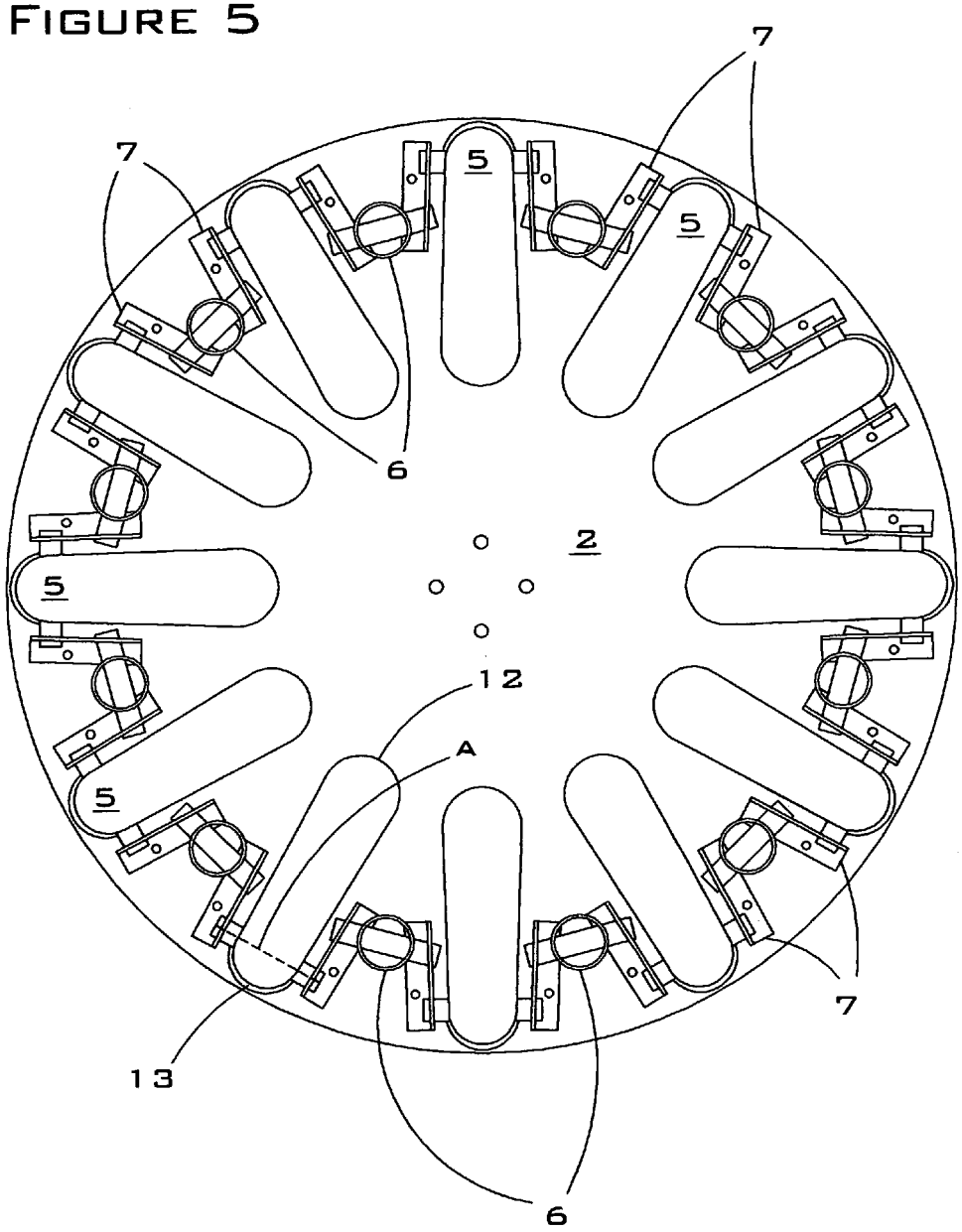
FIG. 5 is a top view of the bottom receiver disc of the first embodiment of the gun rack of the present invention.
Figure 7:
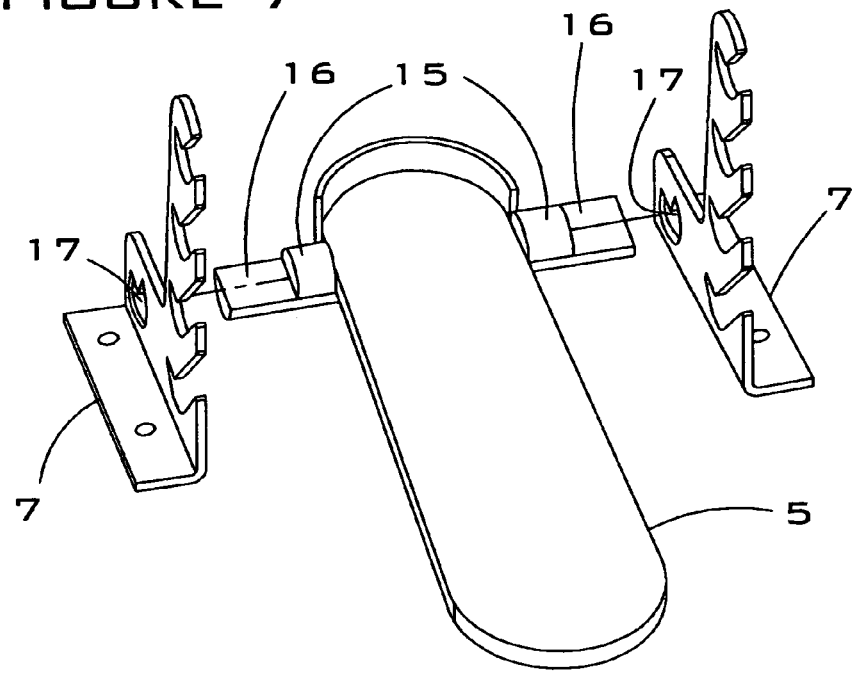
FIG. 7 is a perspective view of a swivel shoe of the gun rack of the present invention.

FIG. 5 is a top view of the bottom receiver disc of the first embodiment of the gun rack of the present invention. This figure shows the orientation of the swivel shoes 5 in relation to the barrel receivers 6 on the bottom receiver disc 2. Both the barrel receivers 6 and the swivel shoes 5 comprise a rod 11. Each end of the rod 11 inserts into an adjacent barrel receiver bracket 7. As shown in FIG. 7, the rod 11 for the swivel shoe 5 is semicircular in shape at the point at which it joins the barrel receiver bracket 7. The semicircular shape of the ends of the rods 11, combined with the shape of the cutouts 17 in the barrel receiver brackets 7 (shown in FIG. 10), enables the swivel shoes 5 to pivot at the point at which the rod 11 attaches to the swivel shoe 5. Thus, the swivel shoe 5 pivots at a point that is in between the toe 12 and heel 13 of the swivel shoe, but closer to the heel 13. The pivot point (or axis of rotation) of the swivel shoe 5 is indicated by line A in FIG. 5.

Figure 6:
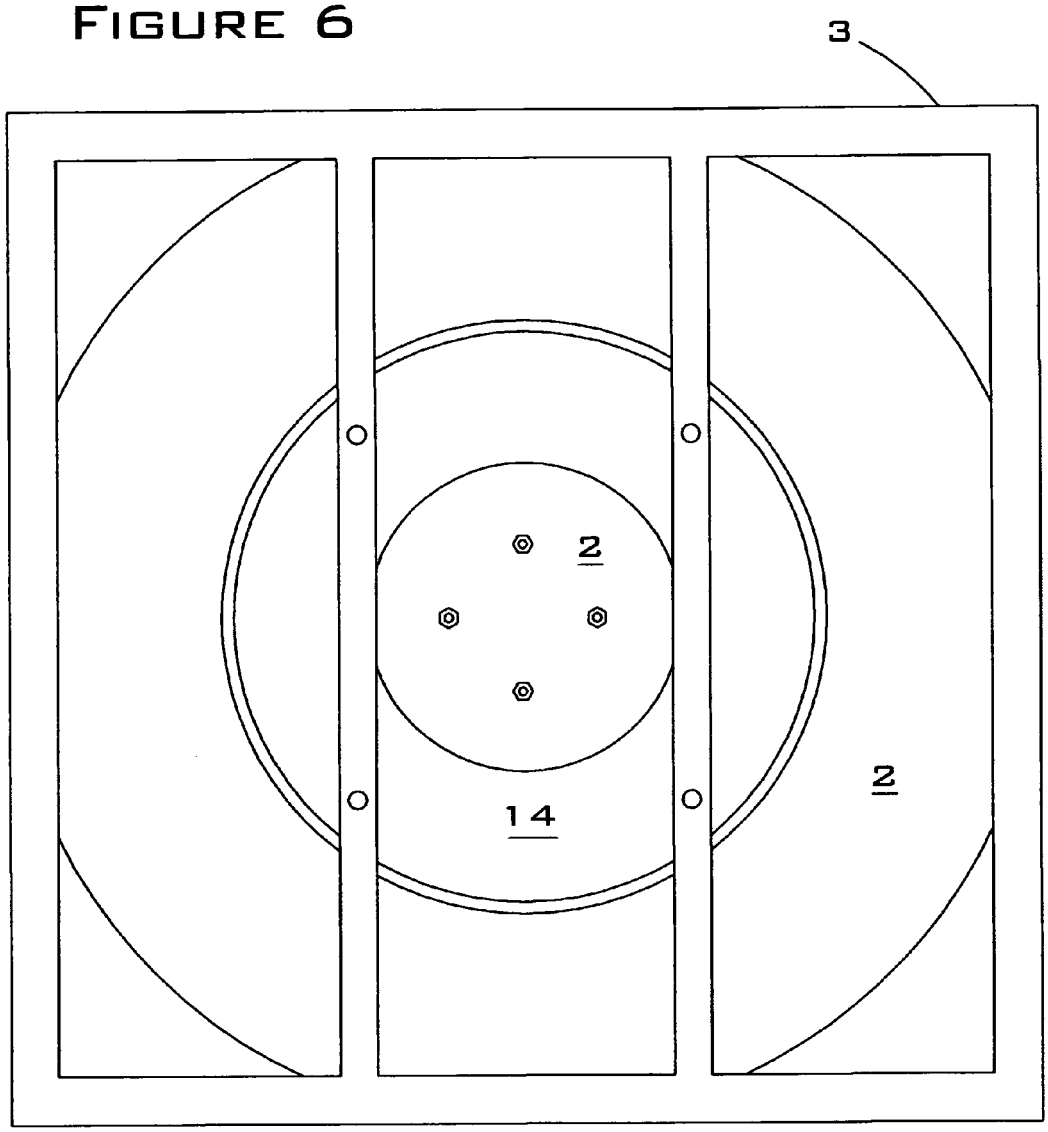
FIG. 6 is a bottom view of the bottom receiver disc of the gun rack of the present invention.

FIG. 6 is a bottom view of the bottom receiver disc of the gun rack of the present invention. This figure shows the base unit 3, the purpose of which is to provide support for the rest of the gun rack. The present invention is not limited to any particular configuration of the base unit, as long as it serves its intended purpose. This view of the gun rack is the same for all three embodiments described herein. This view shows the bearing 14 on the underside of the bottom receiver disc 2. The lower portion of the bearing 14 (shown in FIG. 6) is fixedly attached to the base unit, but the upper portion of the bearing 14 (not shown) is fixedly attached to the bottom receiver disc 2. The rotating upper portion of the bearing 14 causes the bottom receiver disc 2 to rotate, which in turn causes the shaft 4 and the top receiver disc 1 to rotate, while the base unit 3 remains stationary.

FIG. 7 is a perspective view of a swivel shoe of the gun rack of the present invention. This figure shows the two barrel receiver brackets 7 on either side of the swivel shoe 5. As shown in this figure, the rod 11 that protrudes from either side of the swivel shoe 5 has a circular portion 15 and a semicircular portion 16. The circular portion 15 prevents the swivel shoe 5 from moving laterally when the rod is inserted into the barrel receiver bracket 7. The semicircular portion is inserted into a cutout 17 in the barrel receiver bracket 7. Due to the shape of the cutout 17, the swivel shoe can pivot as shown in FIG. 9.

Figure 8:
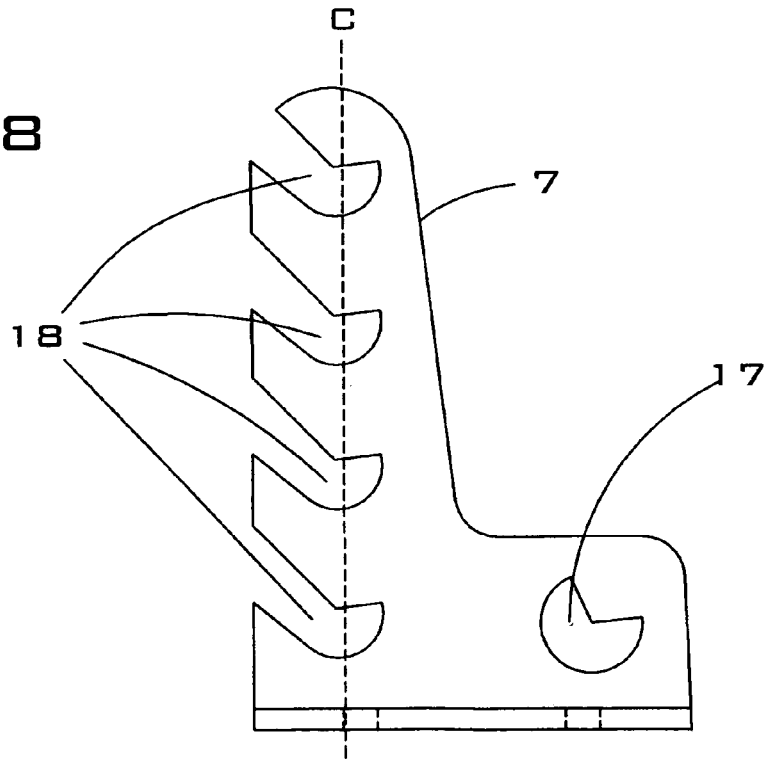
FIG. 8 is a side view of the barrel receiver bracket of the first embodiment of the gun rack of the present invention.

FIG. 8 is a side view of the barrel receiver bracket of the first embodiment of the gun rack of the present invention. The barrel receiver bracket comprises a plurality of notches 18 into which the rod 11 of the barrel receiver 6 (not shown) is inserted. To provide maximum stability to the barrel receivers 6, the notches 18 are preferably lined up vertically, as shown by line C. The different heights of the notches, and the fact that they are open on one end, allows the barrel receivers 6 to be removed and reinserted into a higher or lower notch, to accommodate guns of different lengths. Once fully inserted into the notch, the barrel receiver is stable and does pivot.

Figure 9:
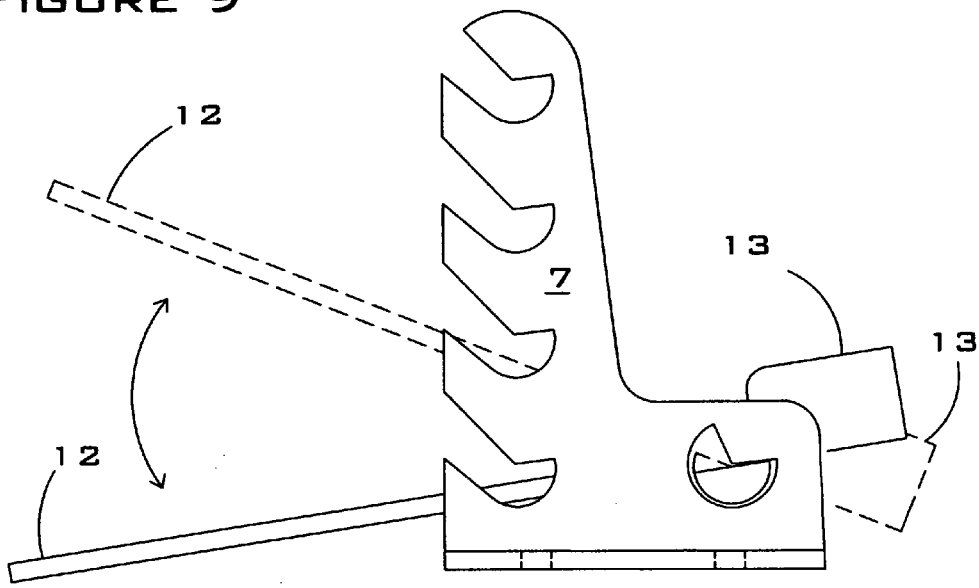
FIG. 9 is a side view of the barrel receiver bracket 7 with the swivel shoe rod 11 inserted into the cutout 17.

FIG. 9 is a side view of the barrel receiver bracket 7 with the swivel shoe rod 11 inserted into the cutout 17. This figure shows the angle of rotation of the swivel shoe. As illustrated, the angle of rotation is greater at the toe 12 of the swivel shoe than at the heel 13 because the pivot point (shown by line A in FIG. 5) is closer to the heel than the toe. By allowing the swivel shoes to pivot, the gun rack of the present invention maintains constant contact with the entire span of the gun butt. Prior art gun racks that have only a flat, stationary receiving surface for the gun butt place proportionately greater pressure on the heel of the butt (opposite the trigger side), as opposed to evenly distributing pressure across the butt. This uneven pressure can cause the recoil pad to break down over time.

Figure 10:
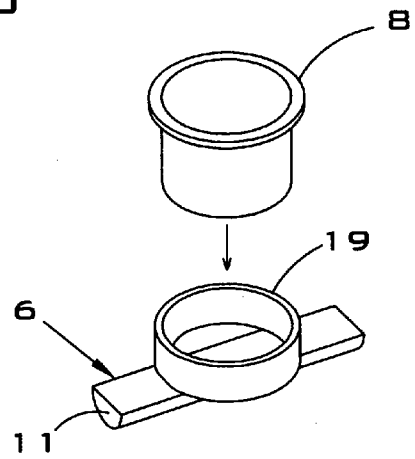
FIG. 10 is a perspective view of the barrel receiver and protective insert of the gun rack of the present invention.

FIG. 10 is a perspective view of the barrel receiver and protective insert of the gun rack of the present invention. The barrel receiver 6 comprises a ring 19 and a rod 11. The rod lies directly underneath the ring 19 and is inserted into the notches 18 in the barrel receiver brackets 7 on either side of the barrel receiver 6.

Figure 11:
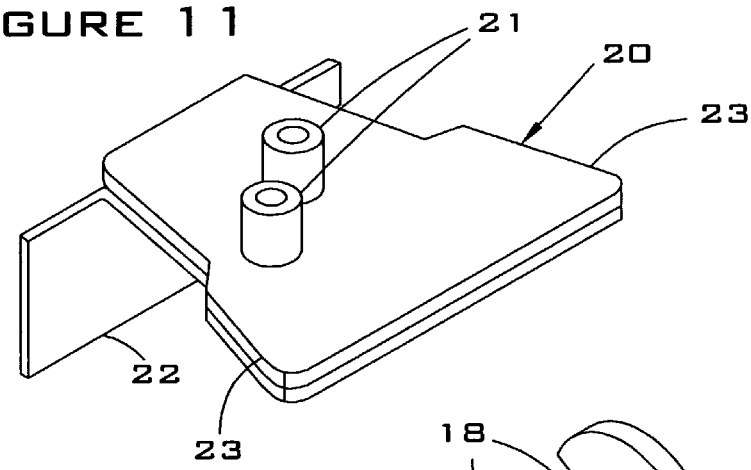
FIG. 11 is a perspective view of the shotgun plate of the gun rack of the present invention.

FIG. 11 is a perspective view of the shotgun plate of the gun rack of the present invention. The shotgun plate 20 is used in connection with the first embodiment and in lieu of the barrel receiver 6 when the barrel of the gun will not fit into the barrel receiver (as, for example, with a double-barrel shotgun). The shotgun plate 20 comprises two pegs 21 that extend upward from the top surface of the shotgun plate. The top surface of the shotgun plate, as well as the outer surface of the pegs, comprises a non-abrasive material (such as polyethylene, polypropylene or neoprene). The same non-abrasive material may be used on the top surface of the shotgun plate and the outer surface of the pegs, or different materials could be used. The bottom portion of the shotgun plate is made of a durable and rigid material, such as steel.

Figure 12:
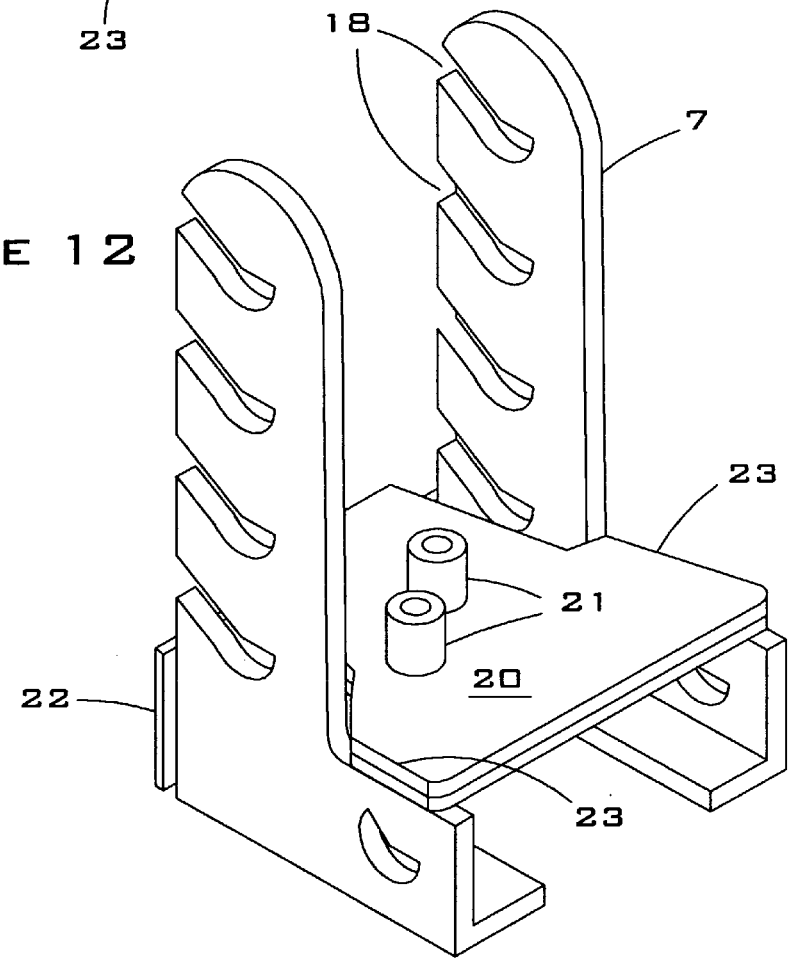
FIG. 12 is a perspective view of the shotgun plate installed on the gun rack of the present invention.

The rear of the shotgun plate comprises a downwardly extending flange 22, which supports the shotgun plate when installed between two receiver brackets. The shotgun plate further comprises two lateral wings 23, which sit atop the barrel receivers brackets 7 directly above the cutouts 17 for the swivel shoes, further stabilizing the shotgun plate. FIG. 12 is a perspective view of the shotgun plate installed on the gun rack.

Figure 13:
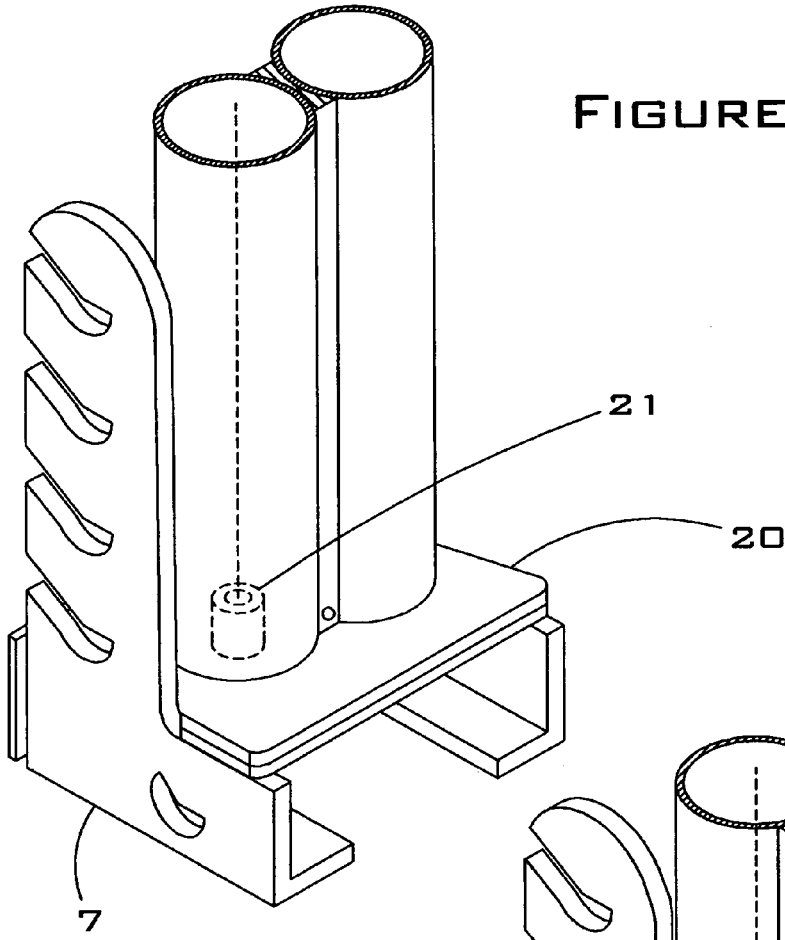
FIG. 13 is a perspective view of the shotgun plate being used with a side-by-side double-barrel shotgun.
Figure 14:
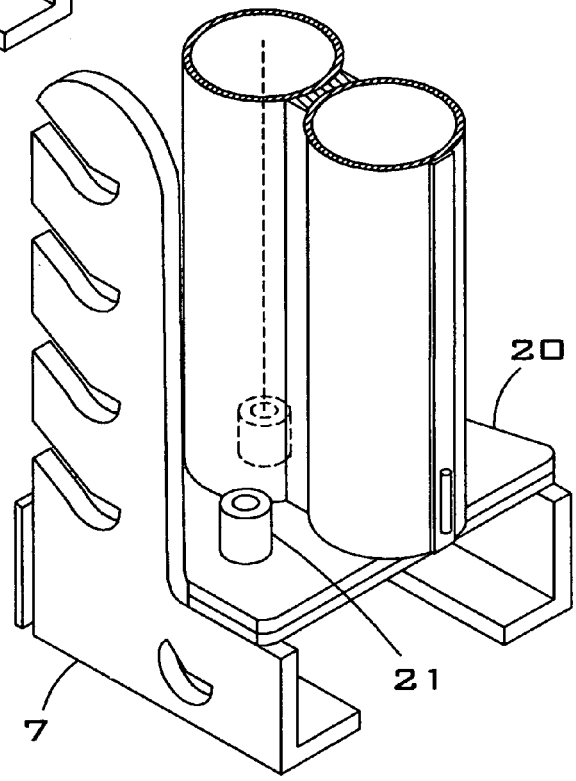
FIG. 14 is a perspective view of the shotgun plate being used with an over-and-under double-barrel shotgun.

The orientation of the pegs 21 is such that the shotgun plate 20 can be used with either a side-by-side or an over-and-under double-barrel shotgun, as well as a single-barrel shotgun. FIGS. 13 and 14 show the shotgun plate being used with a side-by-side double-barrel shotgun and an over-and-under double-barrel shotgun, respectively.

FIGS. 15-20 illustrate the second embodiment of the present invention. In this embodiment, the barrel receivers are not vertically adjustable. In order to compensate for the adjustability lost by eliminating the vertical adjustability of the barrel receivers, the top receiver disc is split in two, and one half of the top receiver disc is positioned lower than the other half in order to accommodate guns of different lengths.

Figure 15:
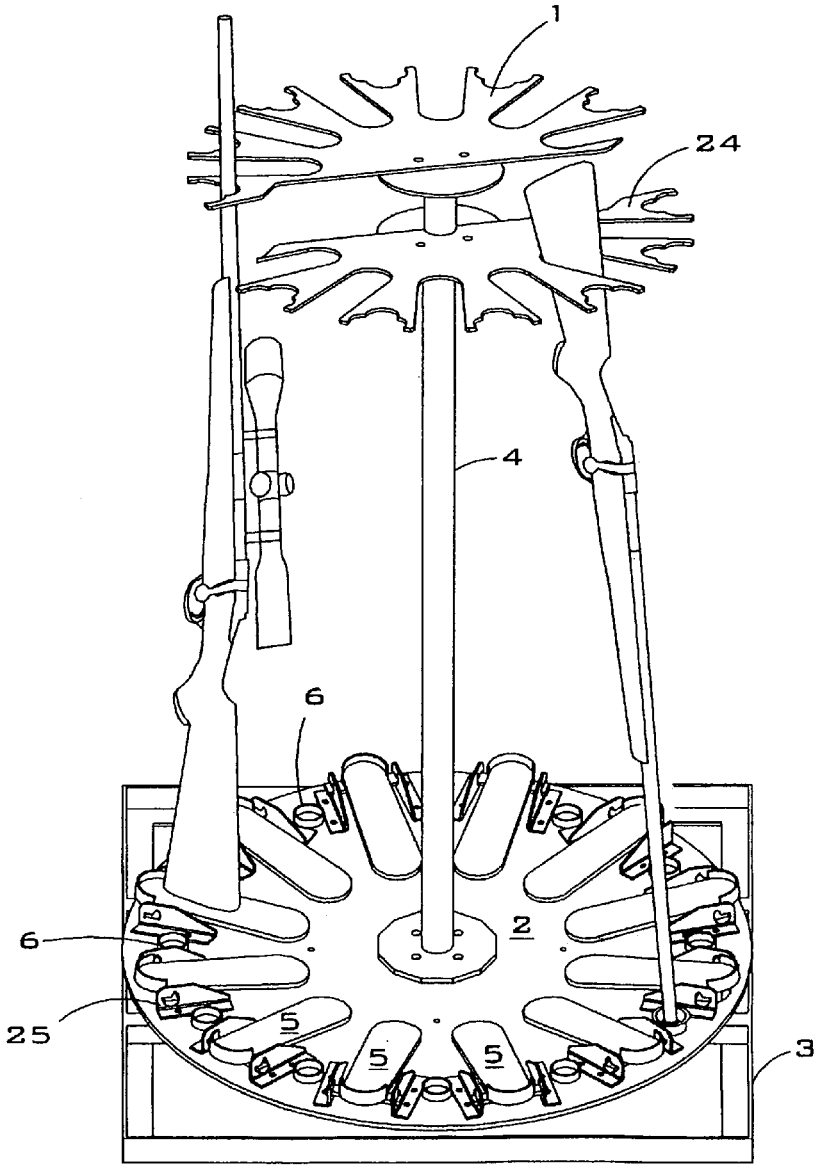
FIG. 15 is a perspective view of the second embodiment of the gun rack of the present invention.

FIG. 15 is a perspective view of the second embodiment of the gun rack of the present invention. This figure shows the top receiver disc 1, the bottom receiver disc 2, and a middle receiver disc 24. The middle receiver disc 24 is positioned on the shaft 4 between the top receiver disc 1 and bottom receiver disc 2, but preferably closer to the top disc 2. The rest of the gun rack is the same as shown in the first embodiment, except that the barrel receiver brackets 7 are replaced with swivel shoe brackets 25, shown in great detail in FIG. 20. The barrel receivers 6 are immovably affixed to the bottom receiver disc 2.

Figure 16:
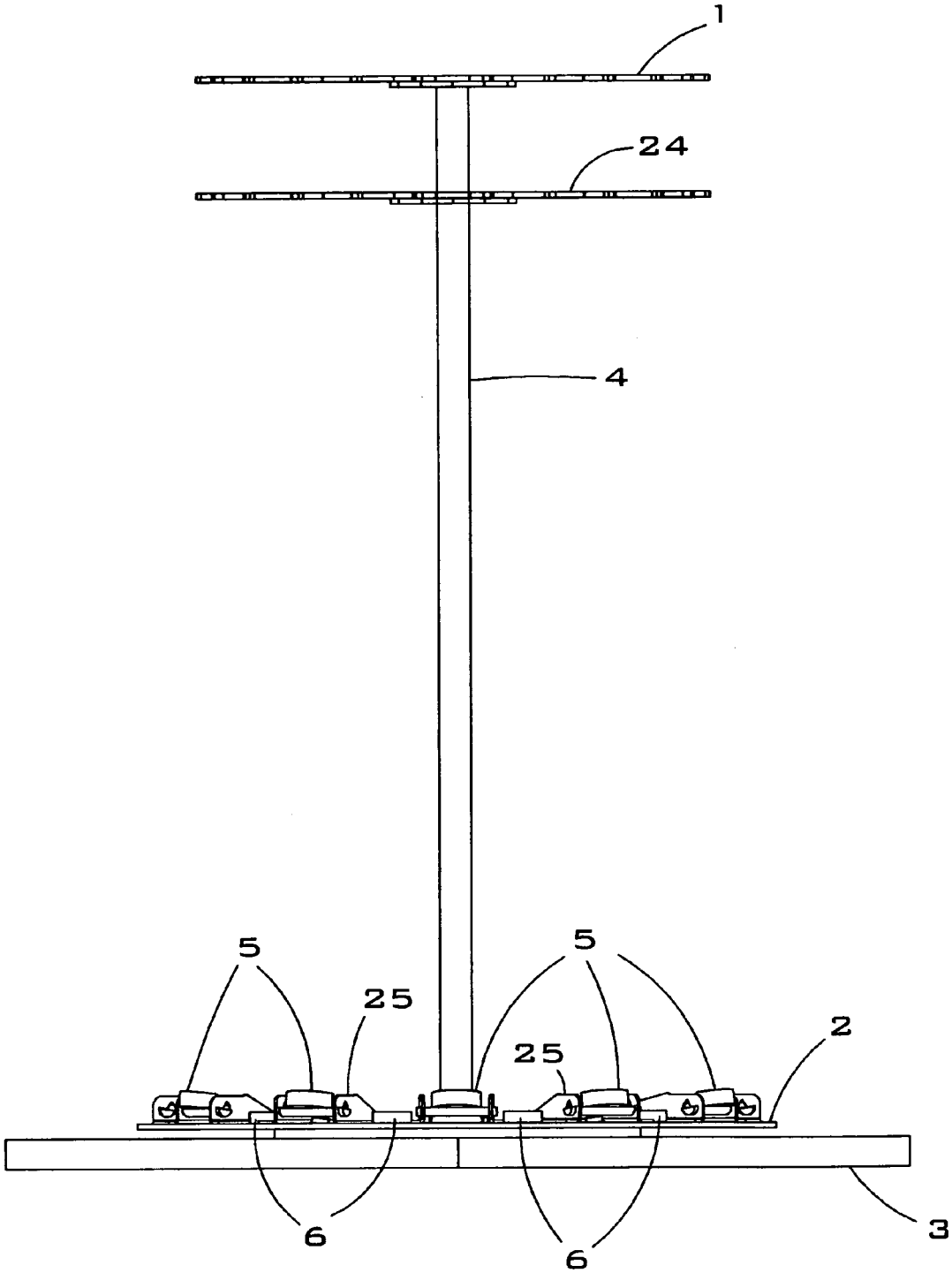
FIG. 16 is a side view of the second embodiment of the gun rack of the present invention.

FIG. 16 is a side view of the second embodiment of the gun rack of the present invention. This figure shows the top, bottom and middle receiver discs 1, 2, 3, the base unit 3, the shaft 4, the swivel shoes 5 and barrel receivers 6, and the swivel shoe brackets 25.

Figure 17:
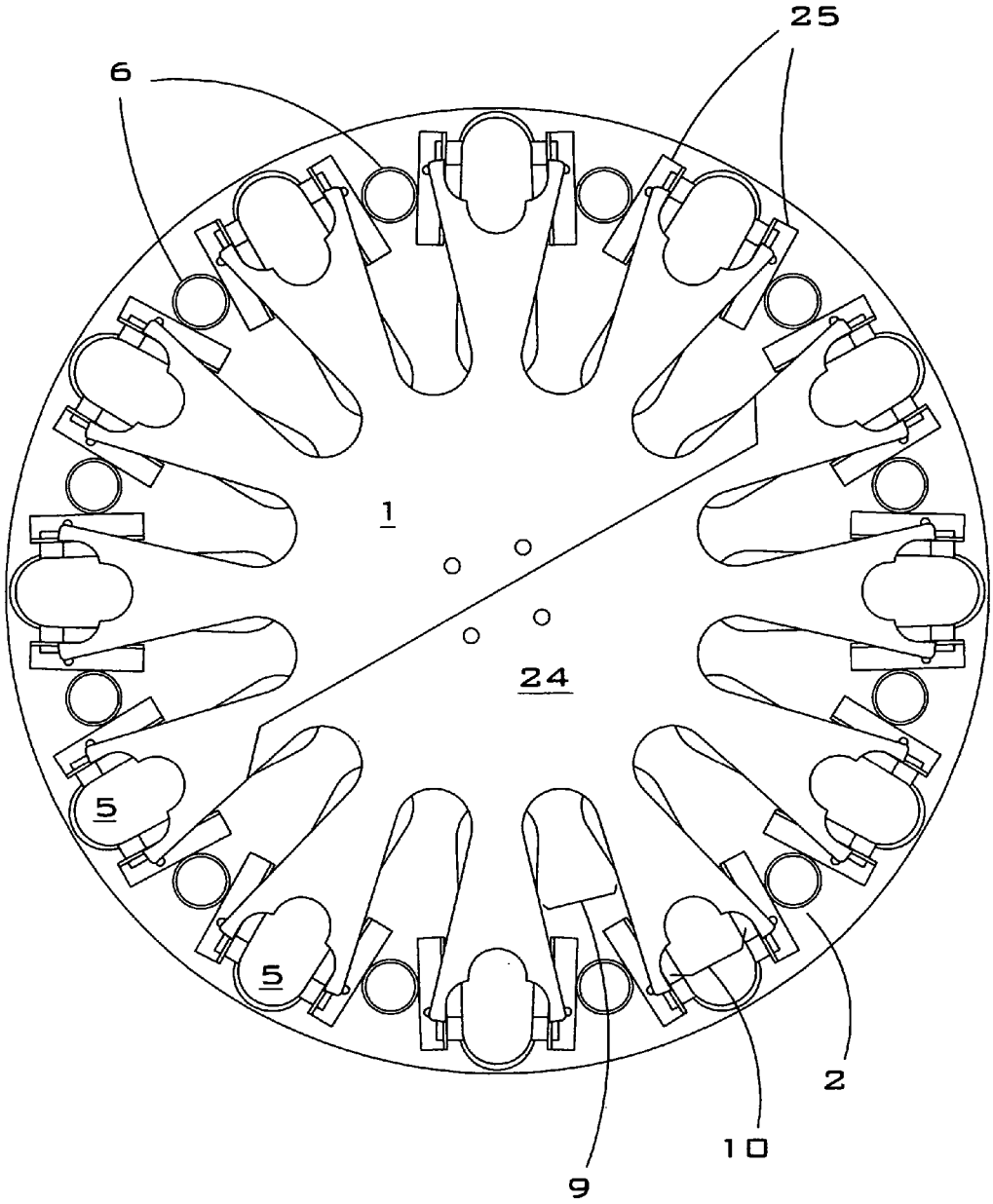
FIG. 17 is a top view of the second embodiment of the gun rack of the present invention.
Figure 18:
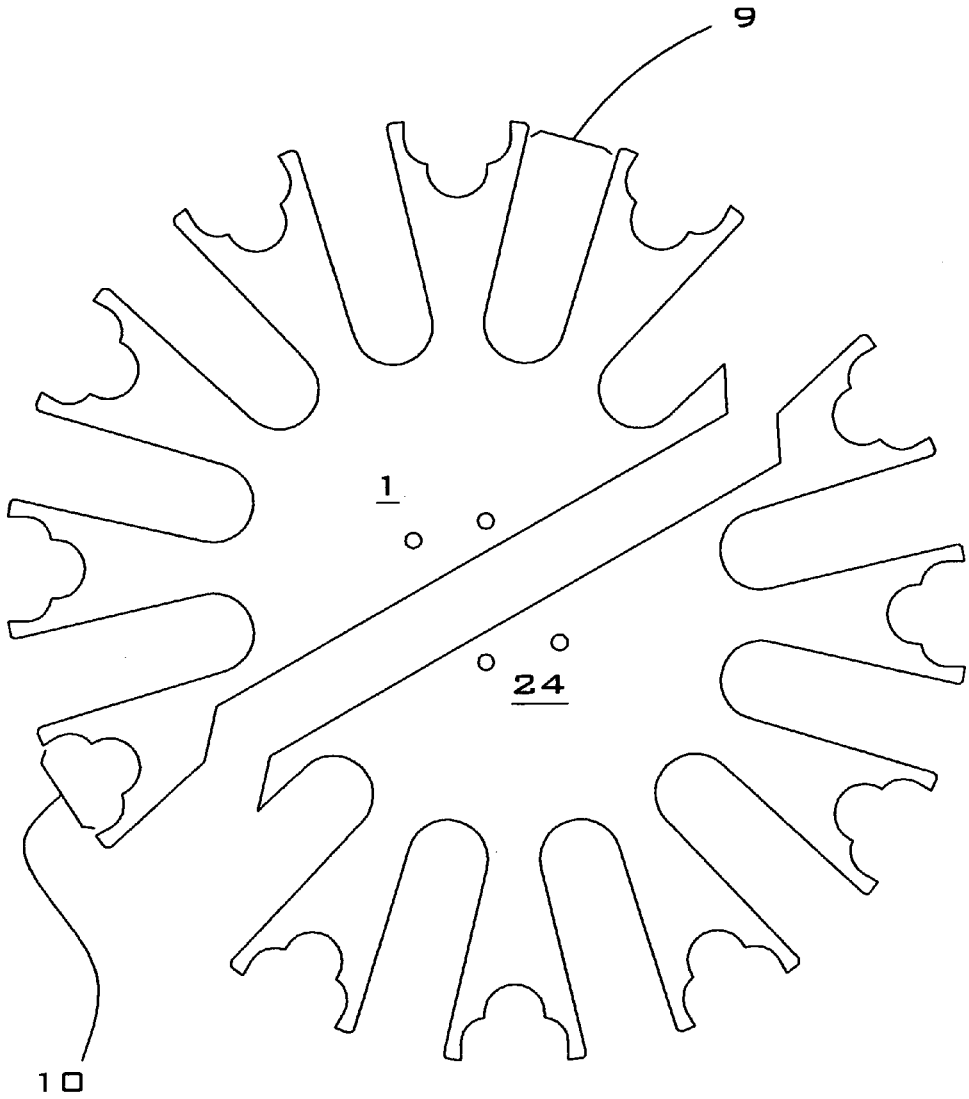
FIG. 18 is a top view of the top and middle receiver discs of the second embodiment of the gun rack of the present invention.

FIG. 17 is a top view of the second embodiment of the gun rack of the present invention. As shown in this figure, the top and middle receiver discs 1, 24, when viewed from the top of the rack, provide the same profile as the top receiver disc 1 alone in the first embodiment. As in the first embodiment, the swivel shoes 5 are vertically lined up with the cutouts 10 in the top and middle receiver discs for the gun barrels, and the barrel receivers 6 are vertically lined up with the cutouts 9 in the top and middle receivers discs for the gun stocks. FIG. 18 is a top view of the top and middle receiver discs of the second embodiment of the gun rack of the present invention. This figure shows more clearly the delineation between the top and middle receiver discs 1, 24.

Figure 19:
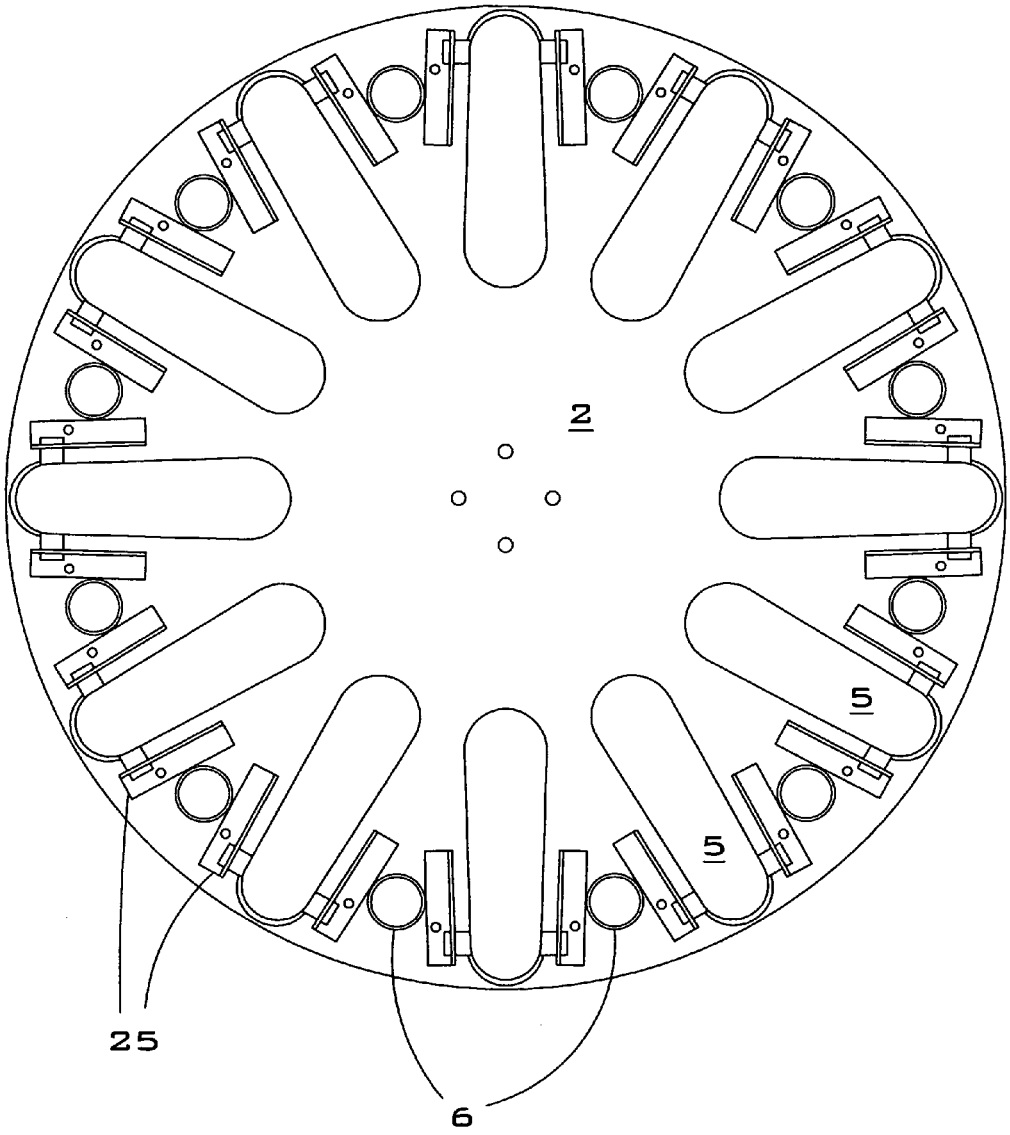
FIG. 19 is a top view of the bottom receiver disc of the second embodiment of the gun rack of the present invention.

FIG. 19 is a top view of the bottom receiver disc of the second embodiment of the gun rack of the present invention. Comparing this figure to FIG. 5, the only difference between the configuration of the swivel shoes 5 and barrel receivers 6 on the bottom receiver disc 2 in the first and second embodiments is that in the second embodiment, the barrel receivers 6 do not have rods 11 (because they are stationary). From the perspective of a top view, the position of the barrel receivers in the first and second embodiments is preferably roughly the same.

Figure 20:
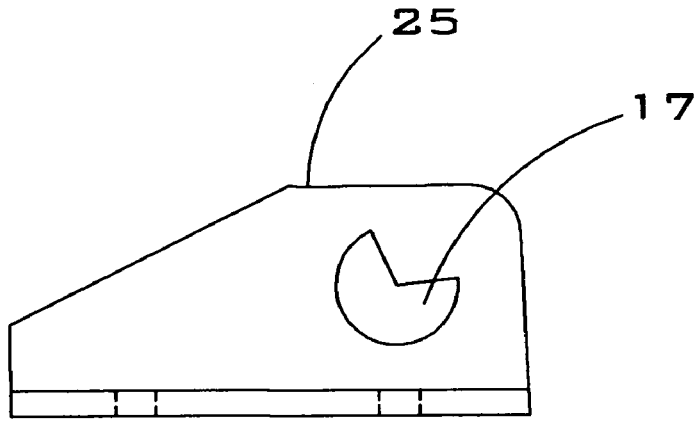
FIG. 20 is a side view of the swivel shoe bracket of the second embodiment of the gun rack of the present invention.

FIG. 20 is a side view of the swivel shoe bracket of the second embodiment of the gun rack of the present invention. In contrast to the barrel receiver bracket 7 of the first embodiment, the swivel shoe bracket 25 has only a cutout 17 for the swivel shoe 5 (not shown) but no notches for the barrel receivers.

FIGS. 21-25 illustrate the third embodiment of the present invention. In this embodiment, there are no barrel receivers on the bottom receiver disc; therefore, all of the guns are held barrel-up. Because this embodiment does not hold any inverted (i.e., barrel-down) guns, there is no need for the cutouts in the top receiver disc for the gun stocks. Accordingly, the top receiver disc only has cutouts for the gun barrels. As in the second embodiment, the brackets are swivel shoe brackets rather than barrel receiver brackets. This embodiment is like the first embodiment in all other respects.

Figure 21:
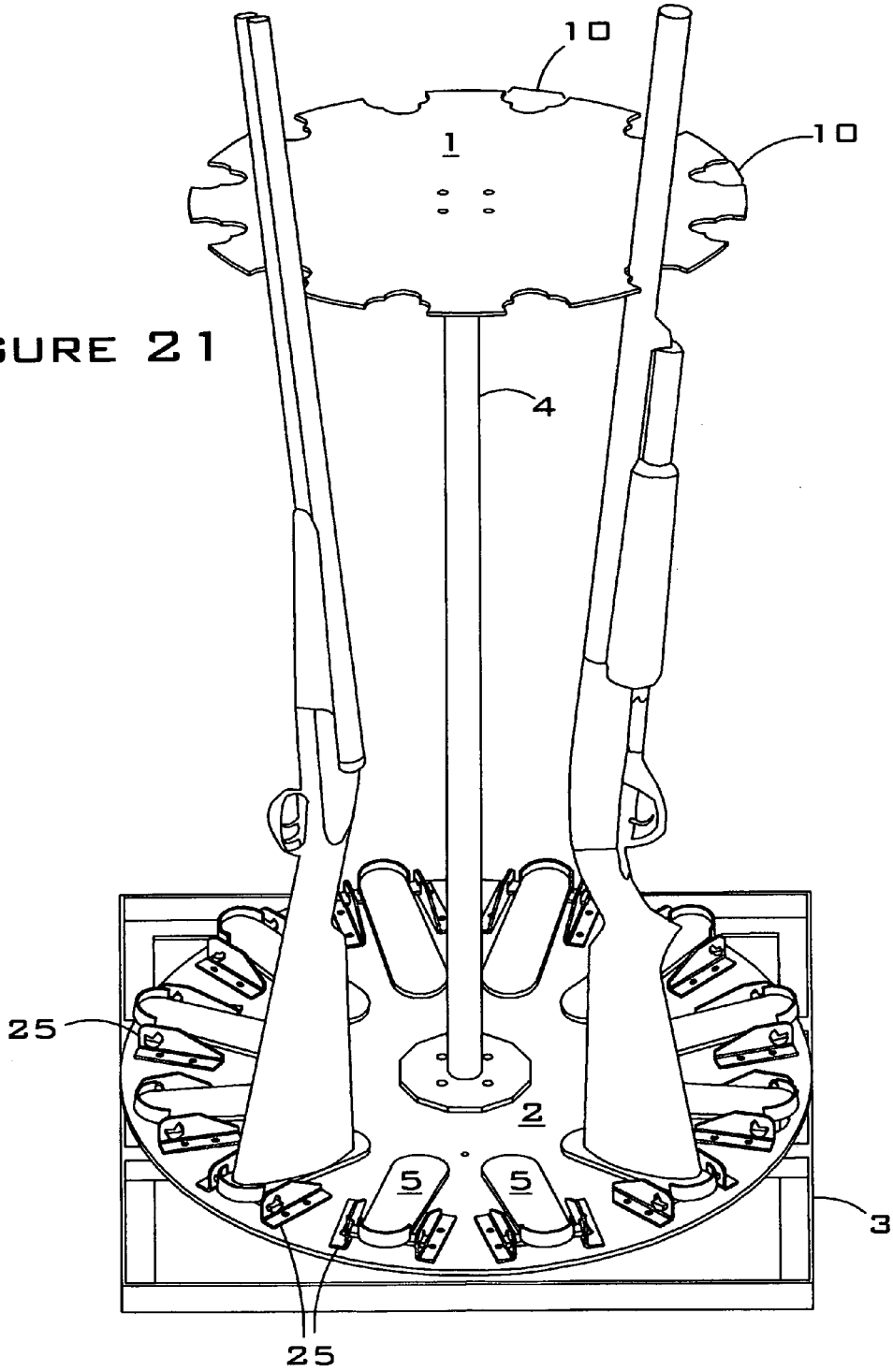
FIG. 21 is a perspective view of the third embodiment of the gun rack of the present invention.

FIG. 21 is a perspective view of the third embodiment of the gun rack of the present invention. As shown in this figure, there are no barrel receivers on the bottom receiver disc, but the swivel shoes are the same as in the first and second embodiments, and the swivel shoe brackets are the same as in the second embodiment. As noted above, the top receiver disc has cutouts for the gun barrels but not for the gun stocks.

Figure 22:
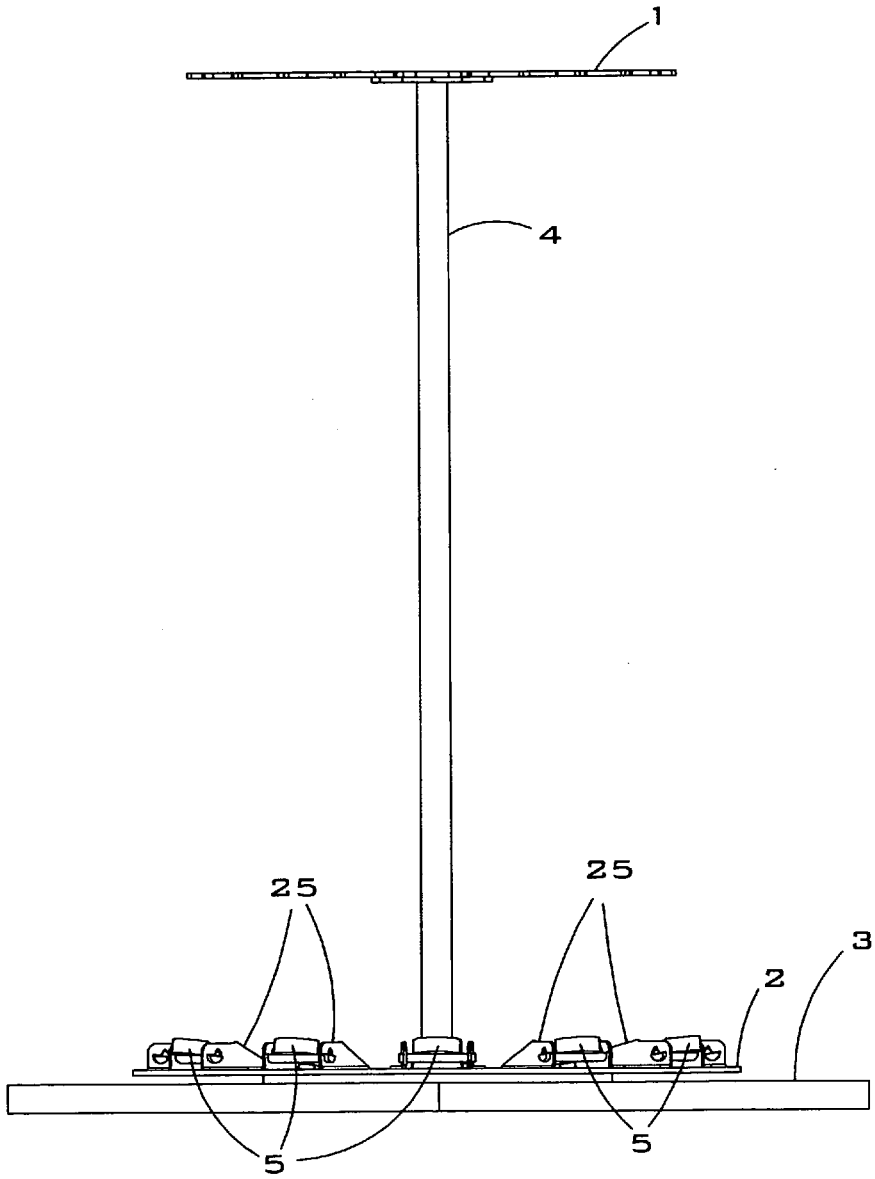
FIG. 22 is a side view of the third embodiment of the gun rack of the present invention.

FIG. 22 is a side view of the third embodiment of the gun rack of the present invention. This figure shows the top receiver disc 1, the shaft 4, the bottom receiver disc 2, the base unit 3, the swivel shoes 5, and the swivel shoe brackets 25.

Figure 23:
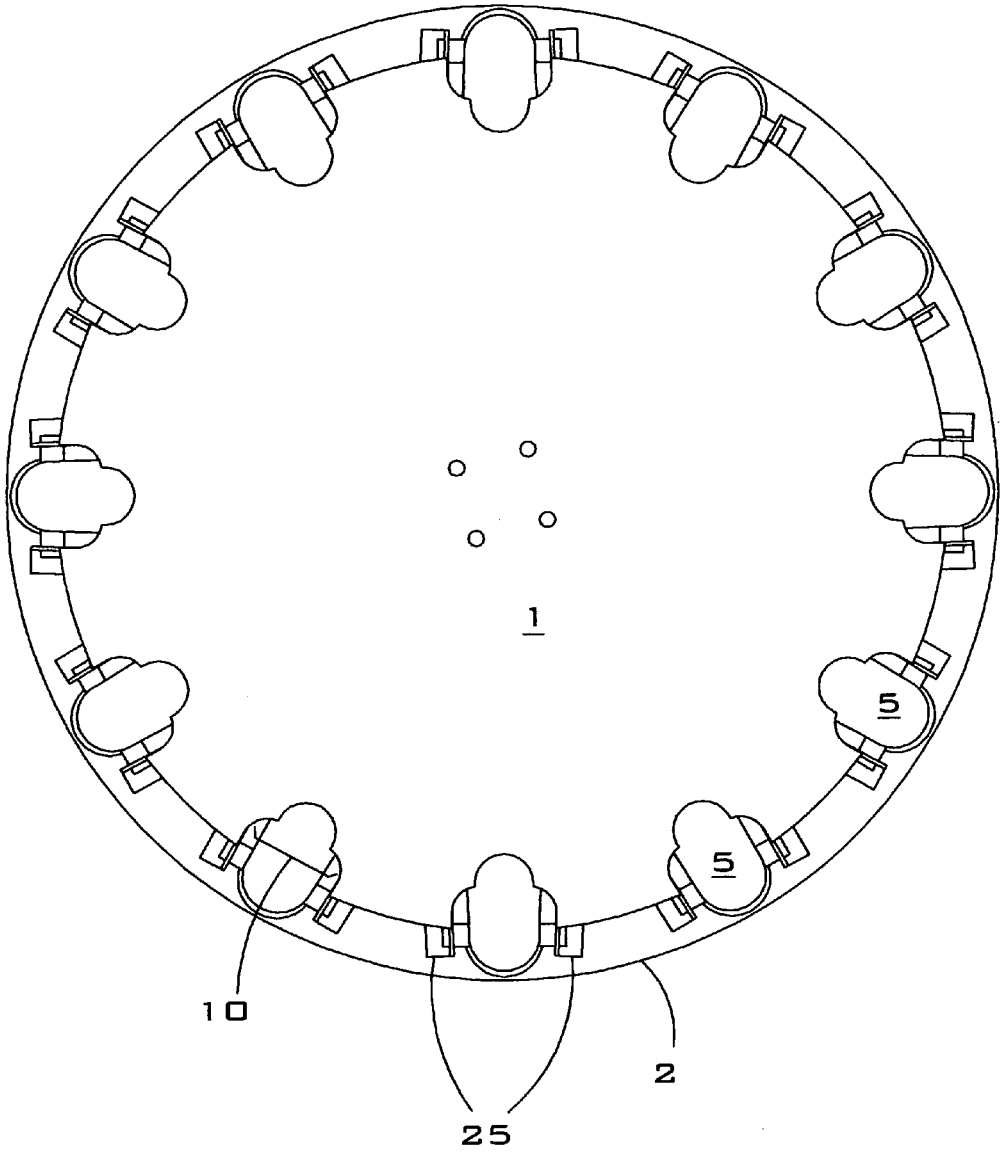
FIG. 23 is a top view of the third embodiment of the gun rack of the present invention.

FIG. 23 is a top view of the third embodiment of the gun rack of the present invention. This figure shows the top receiver disc 1, the bottom receiver disc 2, the swivel shoes 5, and the swivel shoe brackets 25. The vertical orientation of the swivel shoes to the cutouts 10 is the same as in the first and second embodiments.

Figure 24:
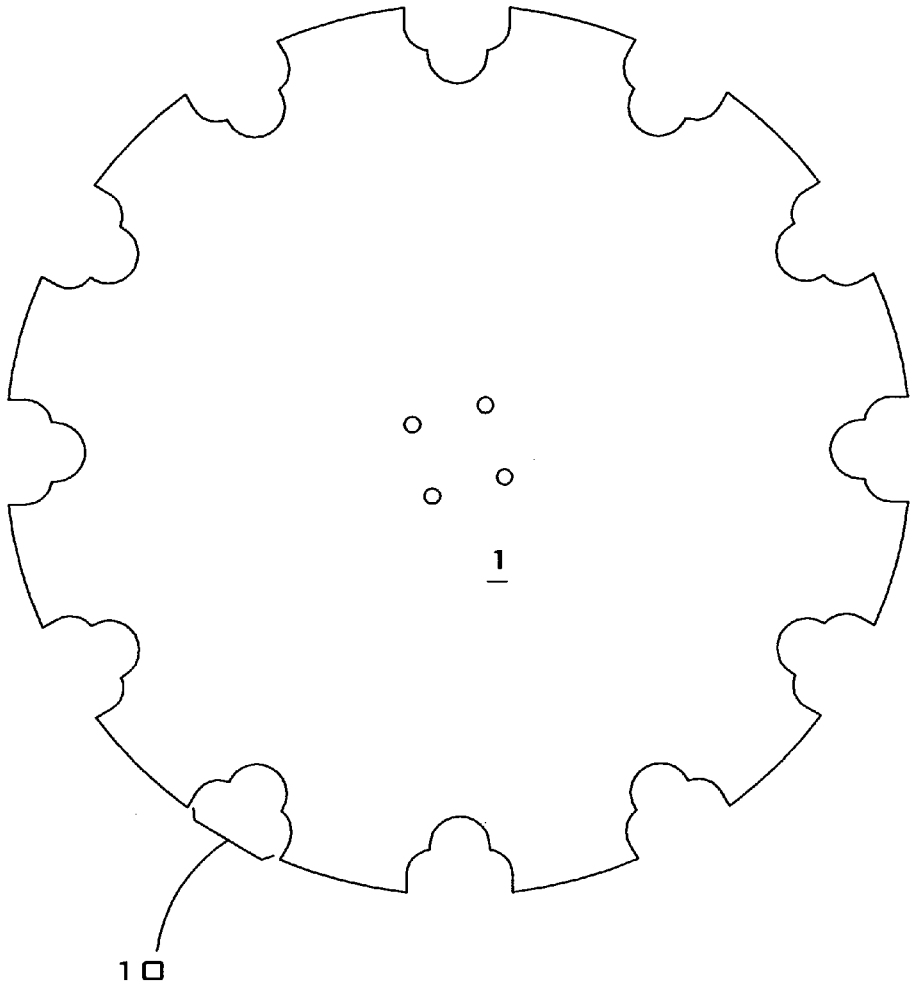
FIG. 24 is a top view of the top receiver disc of the third embodiment of the gun rack of the present invention.
Figure 25:
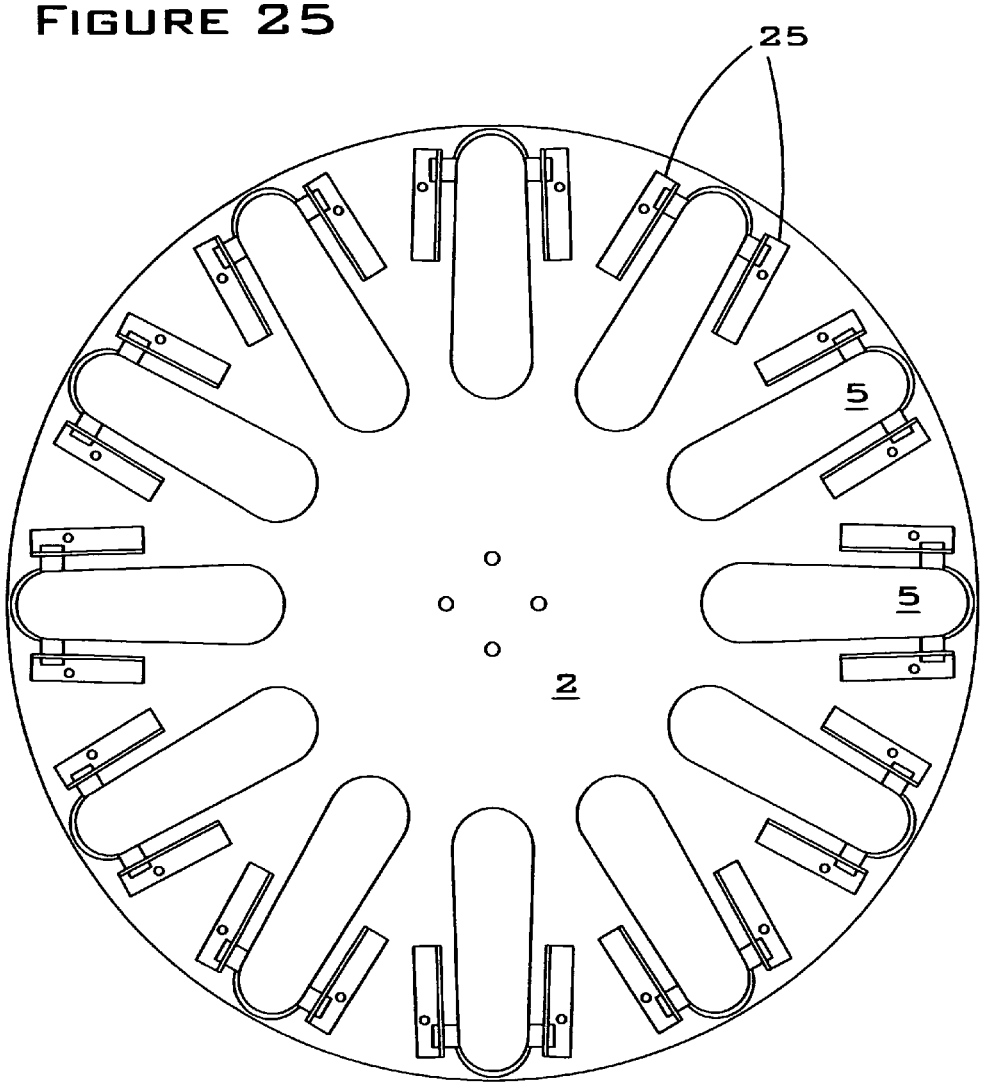
FIG. 25 is a top view of the bottom receiver disc of the third embodiment of the gun rack of the present invention.

FIG. 24 is a top view of the top receiver disc of the third embodiment of the gun rack of the present invention. This figure shows more clearly the cutouts 10 in the top receiver disc 1. FIG. 25 is a top view of the bottom receiver disc of the third embodiment of the gun rack of the present invention. This figure shows the bottom receiver disc 2, the swivel shoes 5, and the swivel shoe brackets 25.

Figure 26:
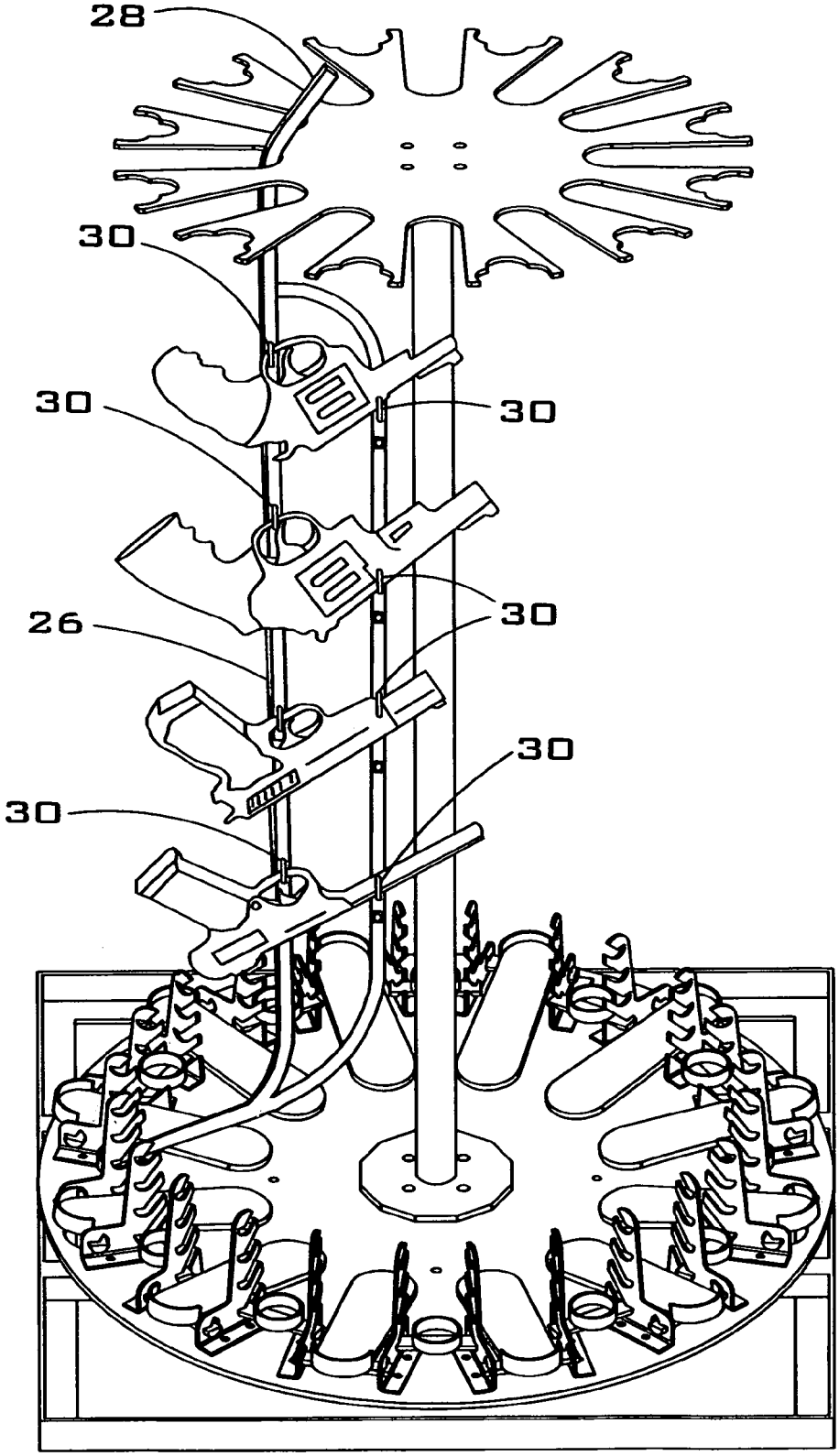
FIG. 26 is a side view of the pistol pole of the present invention installed on the first embodiment of the gun rack.

FIGS. 26-30 relate to a pistol pole attachment that can be used with the first embodiment of the gun rack described above. FIG. 26 is a side view of the pistol pole of the present invention installed on the first embodiment of the gun rack. As shown in this figure, the pistol pole comprises a main branch 26 and a side branch 27. The main branch 26 comprises an inwardly curved end 28, which fits into the cutout 9 for the gun stock in the top receiver disc 1. The main branch 26 and side branch 27 join together at the bottom of the pistol pole to form an insertion end 29 (shown more clearly in FIG. 30), which is fixedly attached to the rod 11 (not shown) of a barrel receiver 6 (with the ring 19). The ring 19 of the barrel receiver prevents the insertion end 29 of the pistol pole from moving from side to side. Both the main branch 26 and the side branch 27 comprise a plurality of hooks 30 for holding pistols. Preferably, the hooks 30 can be turned so that they point upward or downward, depending on the angle needed to secure the pistol.

Figure 27:
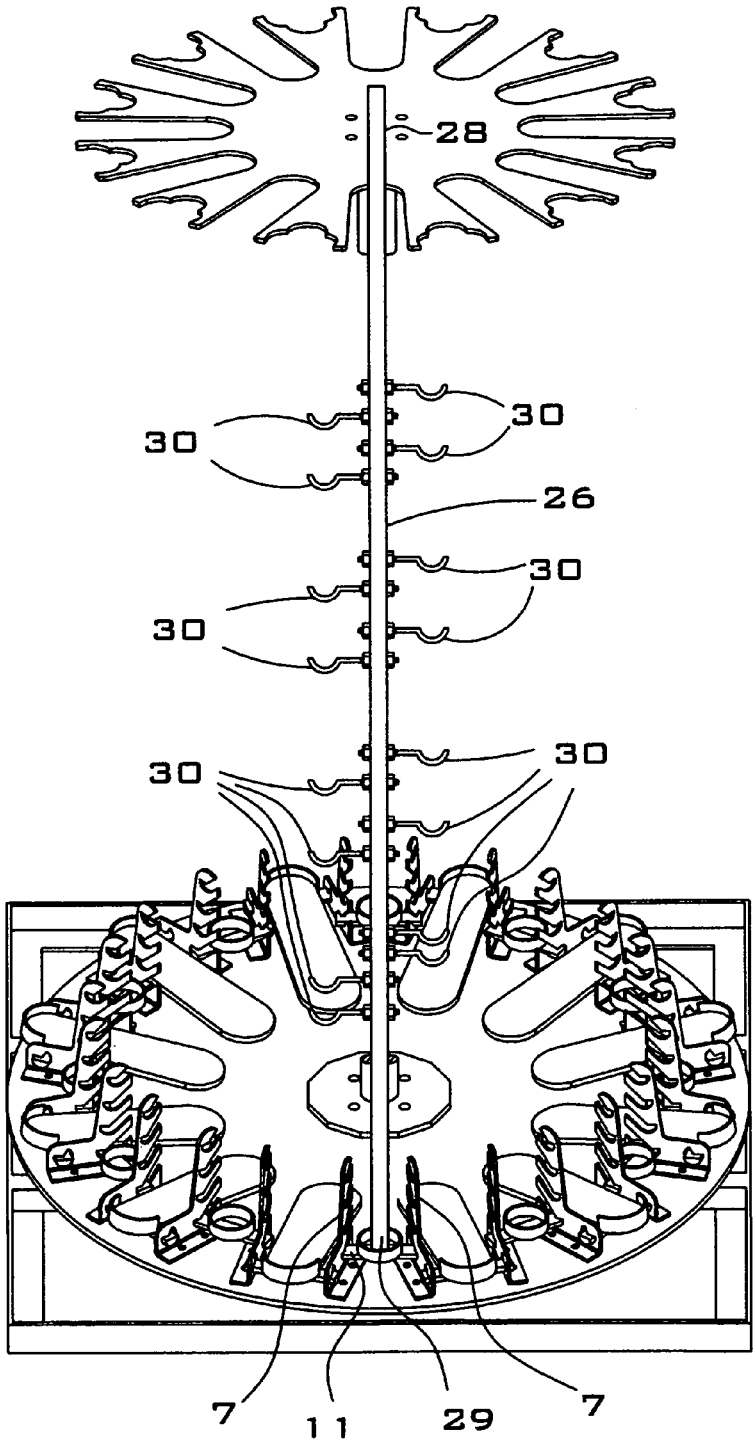
FIG. 27 is a front view of the pistol pole of the present invention installed on the first embodiment of the gun rack.

FIG. 27 is a front view of the pistol pole of the present invention installed on the first embodiment of the gun rack. This figure is shown without the pistols for clarity. This figure shows the main branch 26, the inwardly curved end 28, and the insertion end 29, which is attached to the rod 11 and ring 19. The rod, in turn, is inserted into the notches 18 in the two adjacent barrel receiver brackets 7. This figure also shows the hooks 30 for holding the pistols. The present invention is not limited to any particular number, shape, size or configuration of hooks.

Figure 28:
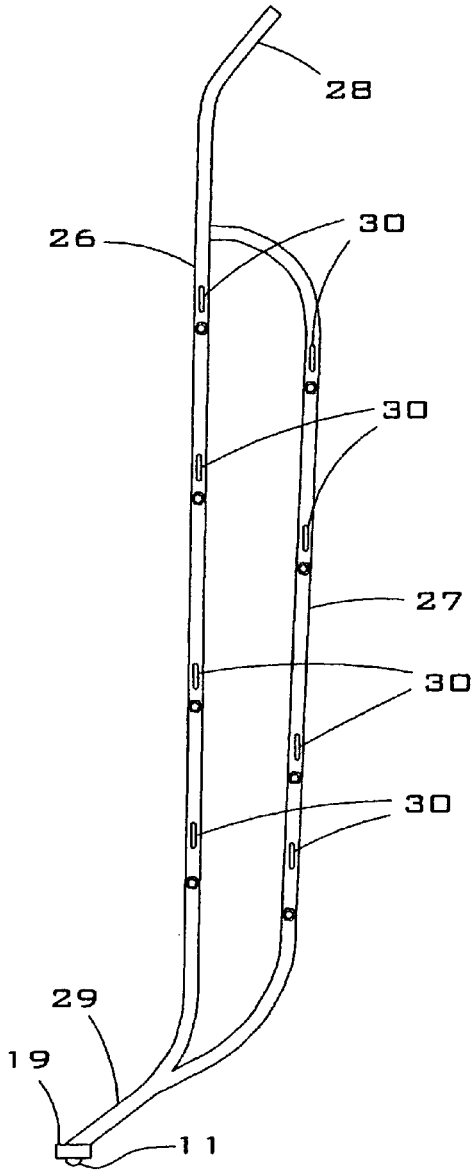
FIG. 28 is a side view of the pistol pole of the present invention standing alone.
Figure 29:
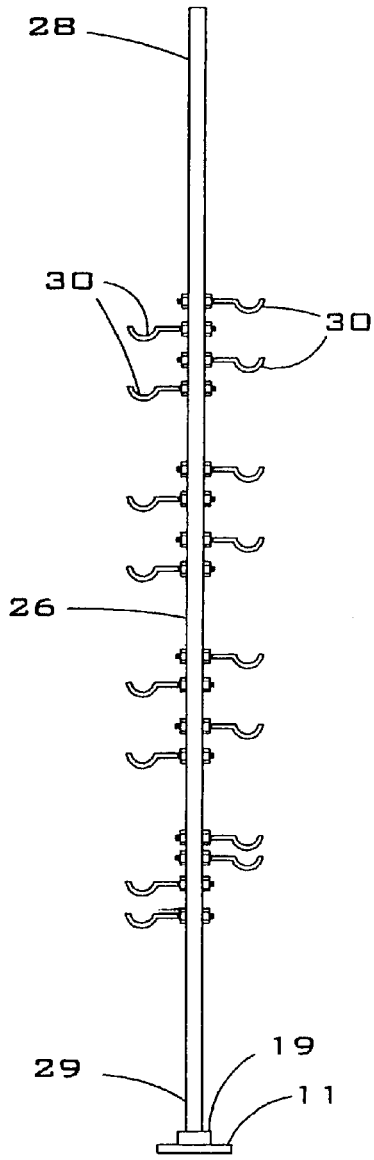
FIG. 29 is a front view of the pistol pole of the present invention standing alone.
Figure 30:
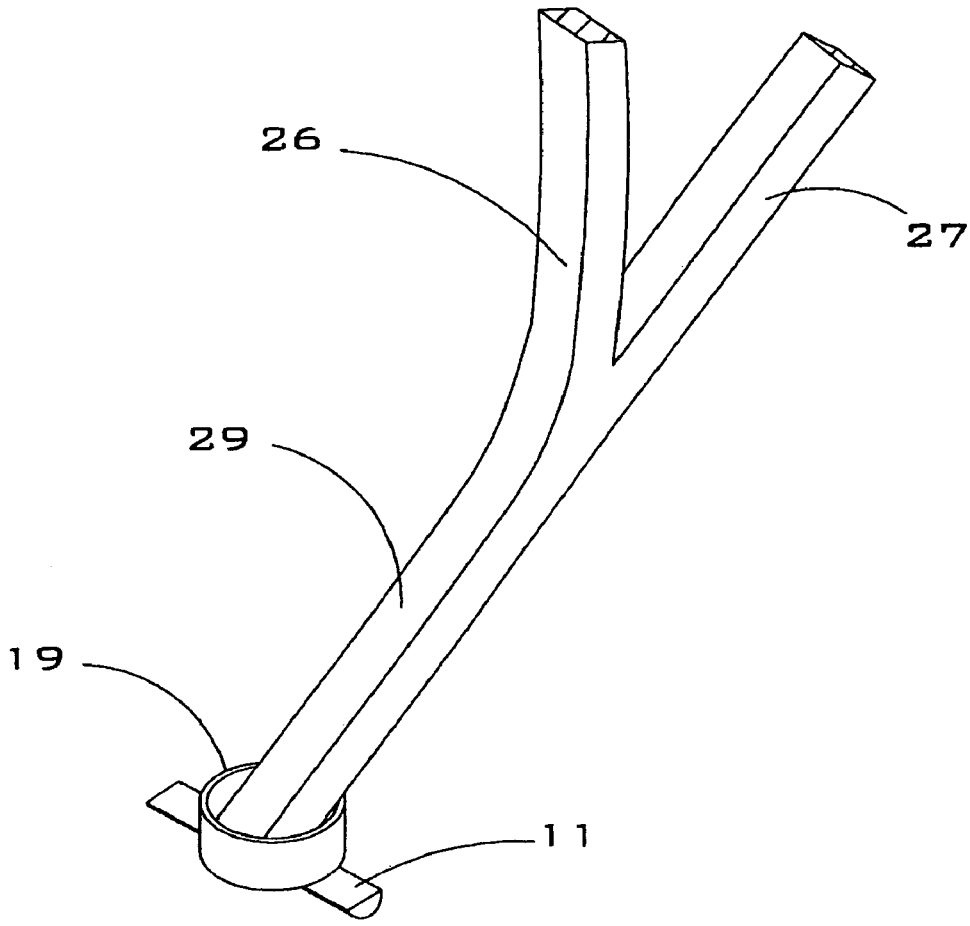
FIG. 30 is a detail view of the point at which the bottom of the pistol pole insert into the barrel receiver.

FIG. 28 is a side view of the pistol pole of the present invention standing alone. FIG. 29 is a front view of the pistol pole of the present invention standing alone. Both of these figures show the main branch 26, the side branch 27, the inwardly curved end 28, the insertion end 29, and the hooks 30, as well as the rod 11 and ring 19. FIG. 30 is a detail view of the point at which the bottom of the pistol pole attaches to the rod. This figure shows the main branch 26 and the side branch 27, which come together to form the insertion end 29. It also shows the insertion end 29 attached to the rod 11 and ring 19.

In any of the embodiments discussed above, the sides of the top receiver disc and, in the case of the second embodiment, middle receiver disc may optionally be coated with a protective material so as to prevent abrasion of the gun barrels.

Although the drawings for the first two embodiments discussed above show the gun rack with provisions for twelve guns down (stock down) and twelve guns up (stock up), and the drawings for the third embodiment show the rack with twelve guns down, the present invention is not limited to any particular number of guns. In fact, the rack can be scaled according to the following formula, where π=pi (approximately 3.14), D=the diameter of the bottom receiver disc, and N=the number of guns:

$$L=(\pi\times D)/N$$

L is the centimeters (or other unit of measurement) of perimeter space per gun. For example, if the intent is to hold 22 guns on a bottom receiver disc with 8 centimeters of perimeter space per gun, then the diameter of the bottom receiver disc would be:

$$8=(3.14\times D)/22$$

$$176=3.14D$$

$$D=56 \text{ centimeters}$$

Although several preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention. For example, the present invention is intended to cover any gun rack with swivel shoes as described herein, regardless of whether the gun rack is configured as shown in the drawings and described in the various embodiments.

I claim:

1. A gun rack comprising a top receiver disc, a bottom receiver disc, a base unit, a shaft, a plurality of swivel shoes, a plurality of barrel receivers, and a plurality of barrel receiver brackets, wherein the shaft is attached to the top receiver disc at one end and the bottom receiver disc at the other end, wherein the bottom receiver disc is attached to a bearing that allows the bottom receiver disc, shaft and top receiver disc to rotate, wherein the bearing is also attached to the base unit, wherein the number of barrel receivers equals the number of swivel shoes, wherein the number of barrel receiver brackets is twice the number of swivel shoes, wherein each swivel shoe is pivotally attached on either side to a barrel receiver bracket, wherein the barrel receiver brackets are attached to the bottom receiver disc, wherein each barrel receiver comprises a rod and a ring, wherein each barrel receiver bracket comprises at least two notches, wherein there is a barrel receiver bracket on either side of each barrel receiver, wherein the rod of each barrel receiver inserts into a notch on the barrel receiver bracket on either side of the barrel receiver, and wherein the height of the barrel receiver can be adjusted by moving the barrel receiver up or down a notch.

2. The gun rack of claim 1, wherein the notches on each barrel receiver bracket are lined up vertically.

3. The gun rack of claim 1, wherein the top receiver disc comprises a plurality of cutouts for gun barrels and gun stocks, wherein the cutouts for the gun stocks line up vertically with the barrel receivers, and wherein the cutouts for the gun barrels line up vertically with the swivel shoes.

4. The gun rack of claim 3, wherein the cutouts for the gun barrels can accommodate a rifle, single-barrel shotgun or double-barrel shotgun.

5. The gun rack of claim 1, further comprising a plurality of protective inserts, wherein the number of protective inserts equals the number of barrel receivers, and wherein the protective inserts are inserted into the barrel receivers.

6. The gun rack of claim 1, further comprising at least one shotgun plate, wherein the shotgun plate is situated between two barrel receiver brackets, wherein the shotgun plate comprises at least two pegs, and wherein the pegs serve to hold the barrel of a side-by-side or over-and-under double-barrel shotgun.

7. The gun rack of claim 6, wherein the top surface of the shotgun plate is coated with a non-abrasive material, wherein the outer surface of the pegs is also coated with a non-abrasive material, and wherein the non-abrasive material on the top surface of the shotgun plate and the outer surface of the pegs may or may not be the same material.

8. A gun rack comprising a top receiver disc, a bottom receiver disc, a base unit, a shaft, a plurality of swivel shoes, a plurality of barrel receivers, and a plurality of barrel receiver brackets, wherein the shaft is attached to the top receiver disc at one end and the bottom receiver disc at the other end, wherein the bottom receiver disc is attached to a bearing that allows the bottom receiver disc, shaft and top receiver disc to rotate, wherein the bearing is also attached to the base unit, wherein the number of barrel receivers equals the number of swivel shoes, wherein the number of barrel receiver brackets is twice the number of swivel shoes, wherein each swivel shoe is pivotally attached on either side to a barrel receiver bracket, wherein the barrel receiver brackets are attached to the bottom receiver disc, wherein each swivel shoe comprises a rod that extends perpendicularly from either side of the swivel shoe, wherein the rod comprises a circular portion and a semicircular portion, wherein there is a barrel receiver bracket on either side of the swivel shoe, wherein the barrel receiver brackets comprise cutouts for the swivel shoe rods, wherein the semicircular portion of each rod is inserted into the cutout on the barrel receiver bracket, wherein the circular portion of each rod prevents the swivel shoe from moving side to side, and wherein the cutouts in the barrel receiver brackets are shaped so that the swivel shoe can pivot.

9. The gun rack of claim 8, wherein each swivel shoe comprises a toe and a heel, and wherein the rod is located closer to the heel of the swivel shoe than the toe.

10. A gun rack comprising a top receiver disc, a bottom receiver disc, a base unit, a shaft, a plurality of swivel shoes, a plurality of barrel receivers, and a plurality of barrel receiver brackets, wherein the shaft is attached to the top receiver disc at one end and the bottom receiver disc at the other end, wherein the bottom receiver disc is attached to a bearing that allows the bottom receiver disc, shaft and top receiver disc to rotate, wherein the bearing is also attached to the base unit, wherein the number of barrel receivers equals the number of swivel shoes, wherein the number of barrel receiver brackets is twice the number of swivel shoes, wherein each swivel shoe is pivotally attached on either side to a barrel receiver bracket, and wherein the barrel receiver brackets are attached to the bottom receiver disc, further comprising a pistol pole, wherein the pistol pole comprises a main branch, a side branch, an inwardly curved end, an insertion end, and a plurality of hooks, wherein the top receiver disc comprises a plurality of cutouts for gun stocks, wherein the inwardly curved end of the pistol pole is inserted into one of the gun stock cutouts in the top receiver disc, wherein the insertion end comprises a rod, wherein the insertion end of the pistol pole is situated between two barrel receiver brackets, wherein each barrel receiver bracket comprises at least one notch, and wherein each end of the rod is inserted into a notch in one of the two barrel receiver brackets on either side of the insertion end of the pistol pole.

* * * * *